US006252477B1

(12) United States Patent
Endo et al.

(10) Patent No.: US 6,252,477 B1
(45) Date of Patent: Jun. 26, 2001

(54) POWER SHUT-OFF CONNECTOR

(75) Inventors: Takayoshi Endo; Mitsuhiko Totsuka; Shigemitsu Inaba; Goro Nakamura; Akira Maeda, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/110,406

(22) Filed: Jul. 6, 1998

(30) Foreign Application Priority Data

Jul. 4, 1997 (JP) ..... 9-179537
Nov. 13, 1997 (JP) ..... 9-311836
Jun. 5, 1998 (JP) ..... 10-157615

(51) Int. Cl.[7] ..... H01H 75/00; H01H 77/00; H01H 9/20; H01H 15/06

(52) U.S. Cl. ..... 335/6; 335/21; 335/167; 200/541

(58) Field of Search ..... 335/6, 14, 21, 335/22, 23, 26, 38, 157, 164–174; 200/321, 323, 253.1, 531, 536, 541, 550, 563, 571

(56) References Cited

U.S. PATENT DOCUMENTS 3,211,154 * 10/1965 Becker et al. ..... 200/541
3,223,802 * 12/1965 Horst ..... 335/267
4,401,958 * 8/1983 Noorigian ..... 335/170

FOREIGN PATENT DOCUMENTS 8-45642 2/1996 (JP) ..... H01T/13/04

* cited by examiner

*Primary Examiner*—Ramon M. Barrera
(74) *Attorney, Agent, or Firm*—Sughrue, Mion, Zinn, Macpeak & Seas, PLLC

(57) ABSTRACT

A power shut-off connector has contact terminals 55, 56 coming into sliding contact with a moving pin 43, a mating portion 54 and a retaining member 45 of the moving pin, an urging member 62 and a driving member (solenoid) 42 with respect to the moving pin. One side of a locking member 45 as a retaining member is coupled to the plunger 44 of a solenoid 42 and the other side is pivotally supported with a bracket 46 and besides the locking member is mated with the mating portion. The solenoid 42 is provided with a second plunger 150 symmetrically and by coupling a second locking member 151 to the plunger 150, the plunger may be mated with the second mating portion 65 of the moving pin 43. In place of the locking member 151, the plunger 44 may be pulled by means of a weight and a folded wire. A mating portion 54 is provided at the leading end of the moving pin 43, and the locking member 45 and a bracket are disposed on the projecting side of the moving pin so as to dispose the solenoid on the side of the moving pin. The locking member is provided with a plastic tip 53. A housing portion for housing a coil spring 62 is provided in the moving pin.

18 Claims, 17 Drawing Sheets

POWER SHUT-OFF CONNECTOR

BACKGROUND OF THE INVENTION

1. Field of the Invention

The present invention relates to a power shut-off connector for breaking the connection between a pair of contact terminals by sliding a moving pin on receiving an external signal.

2. Related Art

A fusible link 37 (hereinafter called FL) or a strong current fuse as shown in FIG. 21 has heretofore been employed for protecting an automobile wire harness. In case overcurrent flows through a circuit as shown in FIG. 22, the soluble substance in the FL 37 will fuse, thus cutting off the current. In FIG. 22, reference numeral 35 denotes a battery; 36, an FL box; 37, FLs; 75, loads such as power windows; 76, a junction or relay box; and 77, blade fuses for a weak current.

However, the protection of the wire harness still remains unsatisfactory because the FL 37 is not fused instantly by a slight short arising from, for example, the rubbing of the wire harness against a vehicle body and the inconvenience is that an electric wire is damaged or injured. Moreover, it poses a serious problem that the FL box 36 for housing a plurality of FLs 37 tends to become large-sized and is hard to hold in the narrow space of a vehicle.

As indicated by a dotted line i in FIG. 23, further, if the instant fusibility in the fusing characteristics (indicated by a solid line ii) is improved so that the FL 37 may be fused quickly even by the slight short, the FL will be fused as a result of the repetition of starting current generation when a motor or the like is started as indicated by a solid line iii. Thus, in the FL 37, there is an electric current area where the protection of the wire harness is difficult since the electric current waveform (i) of the slight short and the starting waveform (iii) of the motor become close to each other.

SUMMARY OF THE INVENTION

A first object of the present invention made in view of the foregoing problems is to provide a power shut-off means capable of shutting off power certainly in an abnormal condition. A second object of the present invention is to make compact a power shut-off means in order that the power shut-off means is efficiently held in the narrow space of an automobile. Further, a third object of the present invention is to prevent a power shut-off means from malfunctioning.

In order to accomplish the objects above according to the present invention, a power shut-off connector comprises a plurality of contact terminals on an input and an output side, a slidable electroconductive moving pin which is brought into contact with the plurality of contact terminals in a plurality of places in the axial direction, a mating portion provided for the moving pin, retaining means with respect to the mating portion, urging means for urging the moving pin in the axial direction, and driving means which is actuated on receiving an external signal and used for breaking the engagement between the mating portion and the retaining means.

The driving means may be a solenoid. Further, the retaining means may be a plunger for the solenoid.

It is also acceptable that the moving pin is provided with a second mating means for fixing a terminal contact position and that urging retaining means is provided for the mating portion.

It is also acceptable according to the present invention that one side of a locking member as the retaining means is coupled to the plunger of the solenoid and that the other side of the locking member is pivotally supported with a bracket, the locking member being capable of mating with the mating portion of the moving pin.

It is also acceptable that the mating portion is provided in the leading end portion of the moving pin. It is also acceptable that the locking member and the bracket are disposed on the projecting side of the moving pin and that the solenoid is disposed on the side of the moving pin. It is also acceptable that the locking member comprises a solenoid coupling portion which is pivotal in the direction in which the plunger is moved back and forth, a base portion extending in a direction perpendicular to the solenoid coupling portion, and a locking portion which is perpendicularly provided for the base portion.

It is also acceptable according to the present invention that a second plunger is provided for the solenoid in symmetrical relation to the plunger and that a second locking member is coupled to the second plunger, the second locking member being capable of mating with the second mating portion of the moving pin. Further, it is also acceptable according to the present invention that the plunger is pulled by a wire in the locking direction of the locking member and that a weight having at least the same weight as that of the plunger is coupled to the turning side of the wire, the weight being subjected to inertial force in the same direction as that of the plunger.

It is also acceptable that the locking member has a plastic tip mating with the mating portion. Further, it is also acceptable that a housing portion with respect to a coil spring as the urging means is formed in the moving pin. Further, it is also acceptable that the plurality of contact terminals each have cylindrical contact portions coming in contact with the moving pin.

DETAILED DESCRIPTION OF THE PREFERRED EMBODIMENTS

A description will subsequently be given of specific embodiments of the invention using the drawings.

Figure 1:
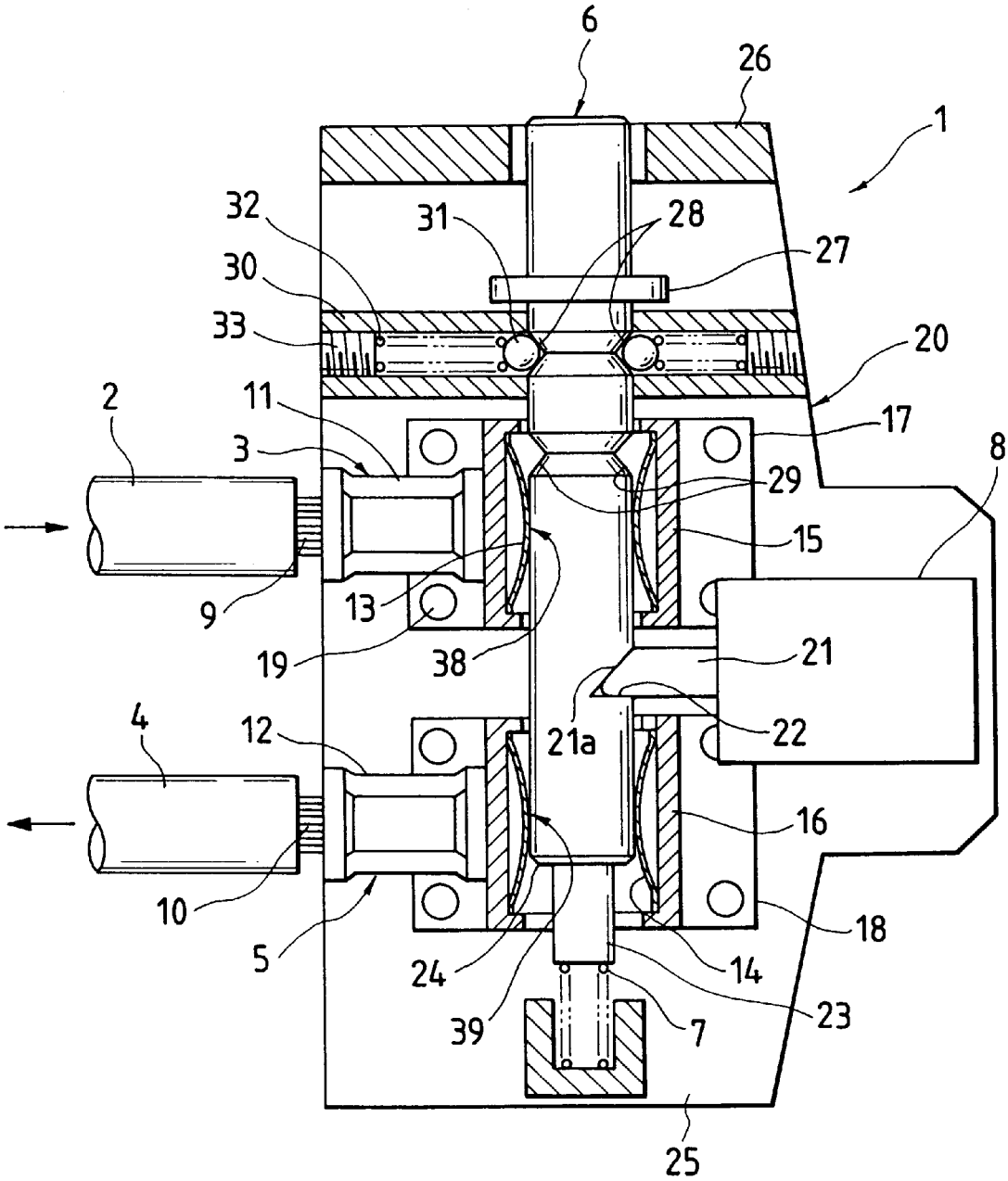
FIG. 1 is an internal structural drawing showing connecting condition in a power shut-off connector and a plan view with a partial sectional view as a first embodiment of the invention.
Figure 2:
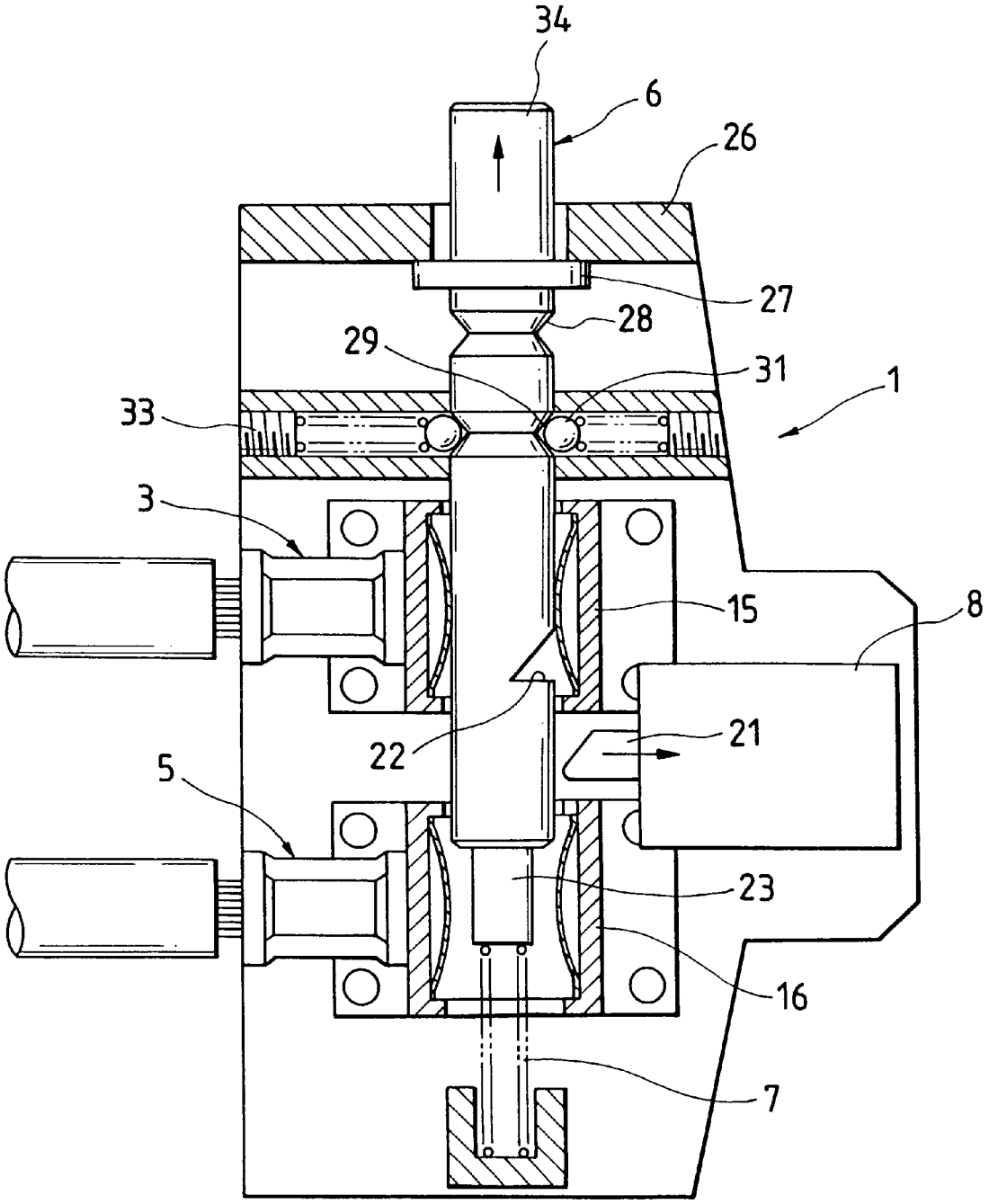
FIG. 2 is an internal structural drawing showing a state in which a circuit has been broken.

FIGS. 1–2 show a power shut-off connector as a first embodiment of the invention.

As shown in FIG. 1, this power shut-off connector 1 comprises an input-side contact terminal 3 connected to a power line 2 led from a battery (not shown), an output-side contact terminal 5 connected to a load-side electric wire 4 led to a wire harness (not shown), a moving pin 6 which is made of electroconductive metal, brought into contact with both contact terminals 3, 5 and axially movable, a compression coil spring 7 as an urging member for urging the moving pin 6 axially, and a solenoid 8 for fixedly retaining the moving pin 6 kept in contact with both contact terminals 3, 5.

The contact terminals 3, 5 comprise pressure welded portions 11, 12 connected to the single conductors 9, 10 of the electric wires 2, 4, and cylindrical contact portions 15, 16 including cylindrical contact spring members 38, 39 having a plurality of contact spring pieces (contacts) 13, 14 which are curved in the form of an arrow and brought into contact with the outer periphery of the moving pin 6, respectively. Both contact terminals 3, 5 are placed in parallel to each other and the cylindrical contact portions 15, 16 are positioned serially in the axial direction of the moving pin 6. The contact terminals 3, 5 are each fixed via brackets 17, 18 to a housing body 20 with bolts 19.

Figure 3:
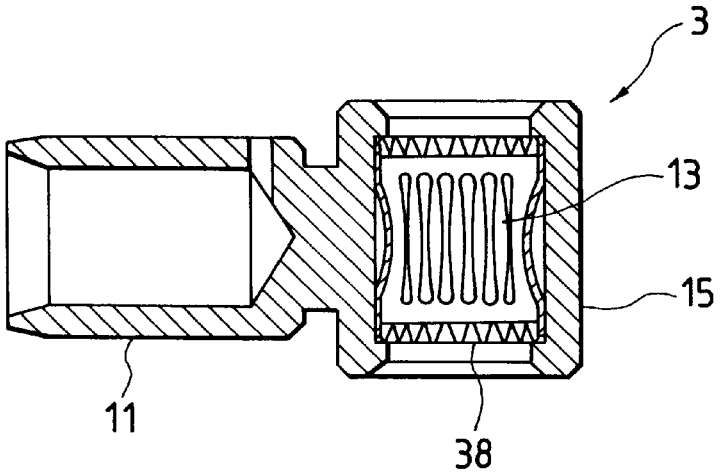
FIG. 3 is a sectional view showing an example of a contact terminal.
Figure 4:
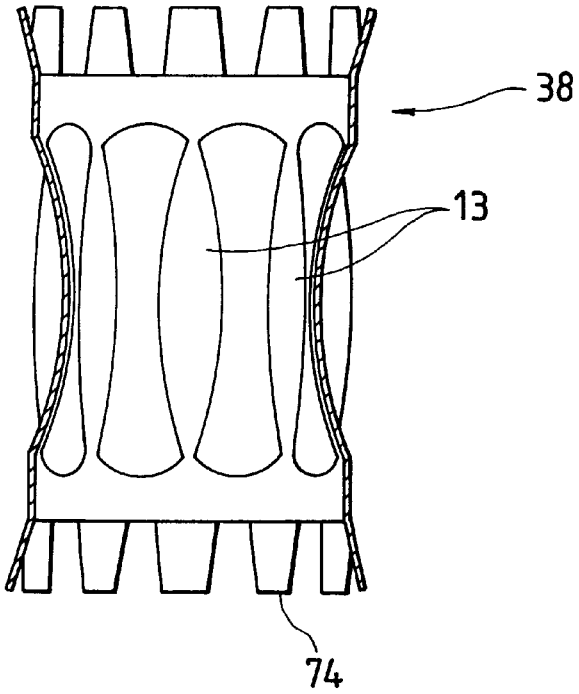
FIG. 4 is a sectional view showing an example of a cylindrical contact spring member.

As shown in an example of the contact terminal of FIG. 3 and by an example of the cylindrical contact spring member within the contact terminal in FIG. 4, each of the cylindrical contact spring members 38, 39 has the plurality of contact spring pieces 13 (14) arranged on its circumference and incorporated in the cylindrical contact portion 15 (16) so that the cylindrical contact spring member 38 is held in a manner free from a backlash with flexible pawl pieces provided on both sides of the cylindrical contact spring member. The contact spring pieces 13, 14 may be those tilted in the form of a louver and performing a spring action. As the cylindrical contact spring members 38, 39 have the plurality of contacts (13, 14) in the circumferential direction of the moving pin 6, the contact resistance becomes reducible and the generation of heat is suppressed when electric current is caused to flow therethrough, whereupon this arrangement is fit for supplying a strong current.

The diameter of the moving pin 6 in FIG. 1 is set greater than the inner diameters of the cylindrical contact spring members 38, 39 of the contact spring pieces 13, 14 in free condition and brought into contact with the contact spring pieces 13, 14 under a certain degree of contract pressure. A mating groove 22 with respect to the plunger 21 (retaining means) of the solenoid 8 is cut-formed in the intermediate portion of the moving pin 6. The mating groove 22 in this example is cut-formed substantially into a triangle and the tip 21a of the plunger 21 is machined like a wedge.

The solenoid 8 is disposed in a direction perpendicular to the moving pin 6 and the plunger 21 perpendicularly engages with the moving pin 6. While the plunger 21 is engaging with the mating groove 22 after being urged by a compression spring (not shown) within the solenoid 8, the cylindrical contact portions 15, 16 of both terminals 3, 5 are brought into contact with the outer peripheral face of the moving pin 6.

A small diameter-portion 23 integral with the moving pin 6 is formed at one end of the moving pin 6 and a tapered chamfer 24 is provided in the shoulder portion of the small-diameter-side moving pin 6. The compression coil spring 7 is resiliently installed in between the leading end of the small-diameter portion 23 and the housing wall 25 of the housing body 20.

A stop flange 27 with respect to the outer wall 26 of the housing body 20 is formed at the other end of the moving pin 6. Further, a pair of lateral V-shaped positioning mating grooves (second mating portions) 28, 29 or otherwise two circumferential mating grooves are axially cut-formed in the moving pin 6 in the proximity of the stop flange 27 with a space held therebetween. The axial space between the mating grooves 28, 29 is set wide enough to ensure that the moving pin 6 is separated from the output-side cylindrical contact portion 16 by axially moving the moving pin 6.

The metal balls 31 of ball plungers (urging retaining means) 30 engage with the (first) mating groove 28 on one side. The balls 31 are urged by coil springs 32 in the diametric direction of the moving pin 6. While the moving pin 6 is kept in contact with both cylindrical contact portions 15 16, the balls 31 are disposed so as to engage with the first mating groove 28 set closer to the leading end of the pin. There are provided a pair of ball plungers 30 in a direction perpendicular to the moving pin 6, each being situated on one side and the other side of the moving pin 6. The urging force of the coil springs 32 is made adjustable by screw members 33.

In the state of FIG. 1, current from the battery (not shown) flows from the input-side cylindrical contact portion 15 through the moving pin 6 and then from the output-side cylindrical contact portion 16 toward the wire harness (not shown).

A circuit arrangement is made for the solenoid 8 so that an air bag signal (for actuating the air bag) at the time of a vehicle collision, for example activates the solenoid 8. Overcurrent can otherwise be dealt with by utilizing a signal resulting from the detection of a slight short or the abnormal temperature of an electric wire. In addition, various signals are utilizable to ensure safety in vehicle traveling.

Figure 5:
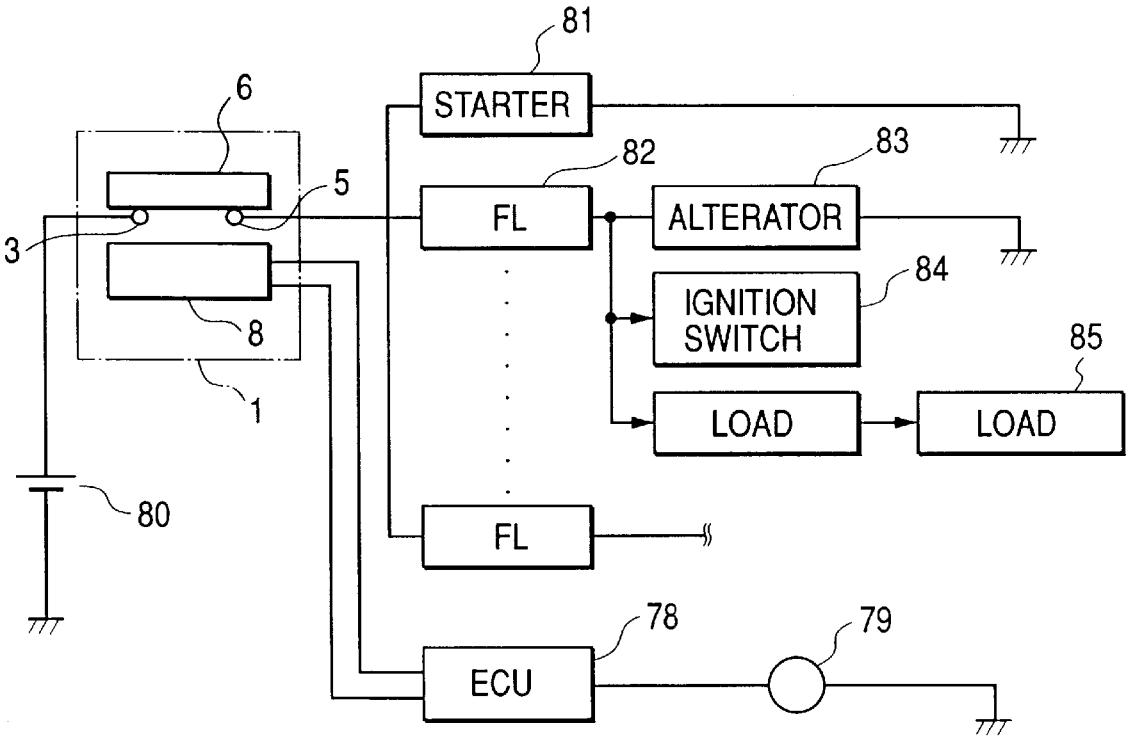
FIG. 5 is a circuit diagram illustrating an example of a connection circuit of the power shut-off connector.

FIG. 5 shows an example of a circuit in which the ECU (Electronic Control Unit) 78 of an air bag and a power shut-off connector 1 are connected and as shown in this example the ECU 78 is connected to a G sensor 79; the one-side contact terminal 3 of the power shut-off connector 1 is connected to a battery 80; the moving pin 6 is brought into contact with the one-side contact terminal 3 and the other side contact terminal 5; a starter 81 is connected to the other side contact terminal 5; and an alternator 83, an ignition switch 84, a load 85 and the like are also connected thereto via FL 82.

Figure 6:
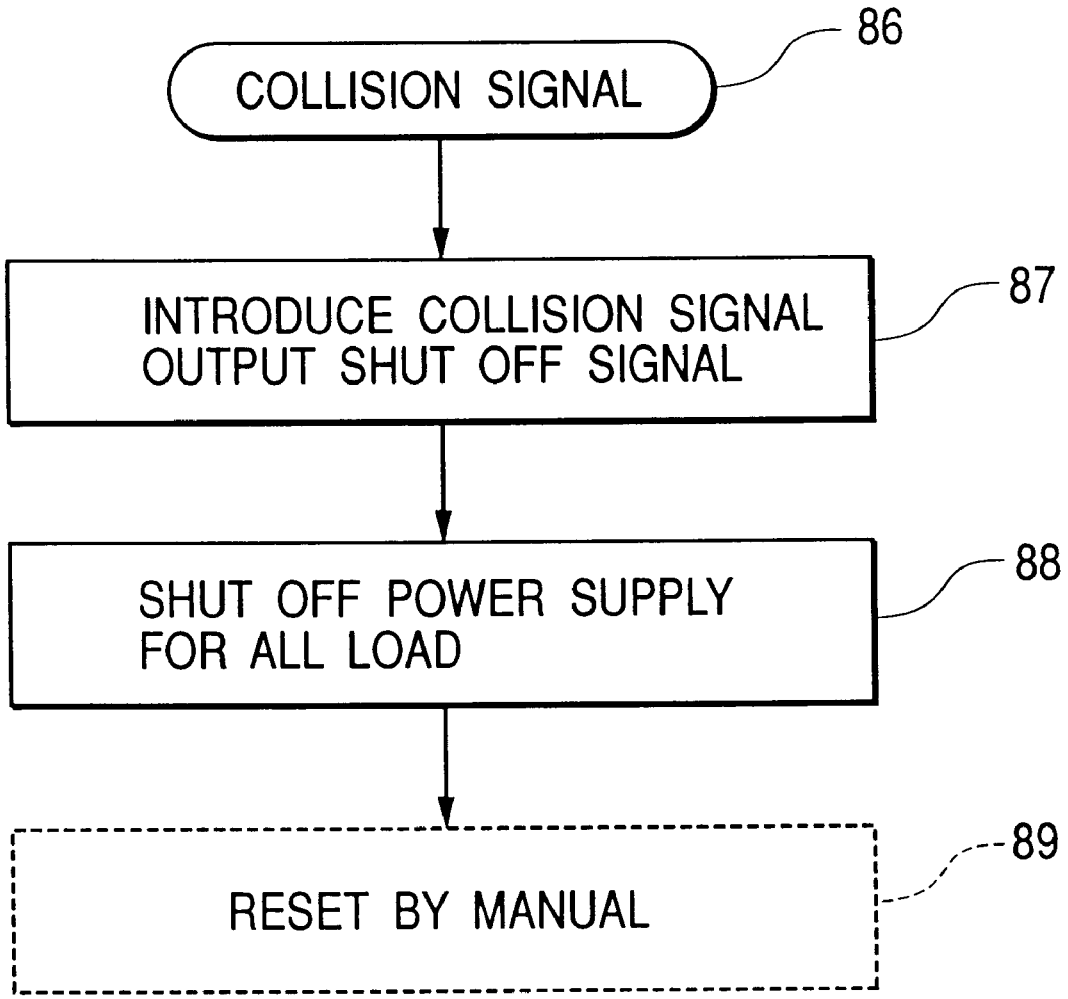
FIG. 6 is a flowchart showing a shut-off process.

As shown in FIG. 6, a collision signal 86 detected by the G sensor 79 (FIG. 5) is fetched by the ECU 78 (FIG. 5) of the air bag before being output as a shut-off signal, whereby the solenoid 8 of the power shut-off connector 1 (FIG. 5) is operated and when the moving pin 6 (FIG. 5) is moved, the supply of power to the whole load is cut off as indicated by reference numeral 88. As indicated by reference numeral 89, further, the power shut-off connector 1 thus disconnected can be reset manually.

More particularly, the plunger 21 is pulled in when the solenoid 8 operates as shown in FIG. 2 and the locked condition of the moving pin 6 is released. Then the moving pin 6 is urged by the force of the compression coil spring 7 toward the input-side terminal 3 and the power circuit is broken as the electrical connection of the output-side contact terminal 5 with the cylindrical contact portion 16 is broken. The small-diameter portion 23 of the moving pin 6 is positioned in the cylindrical contact portion 16. The moving pin 6 is caused to smoothly slide along the cylindrical contact portion 15 and the balls 31 when the balls 31 are separated from the one-side mating groove 28 and engage with the other side mating groove 29, whereupon the moving pin 6 is held in the power shut-off position. The stop flange 27 is brought into contact with the outer wall 26 of the housing and the leading end portion 34 of the moving pin 6 is projected outward from the outer wall 26 of the housing.

The shut-off condition is released by pushing the leading end portion 34 to move and bring the moving pin 6 into contact with the output-side contact terminal 5. Simultaneously, the balls 31 are separated from the other mating groove 29 and engage with the one-side mating groove 28. Then, the plunger 21 of the solenoid 8 released from the operating condition is urged by the spring to project and engage with the mating groove 22. Thus, the moving pin 6 is brought into contact with both terminals 3, 5 and retained thereby.

Figure 19:
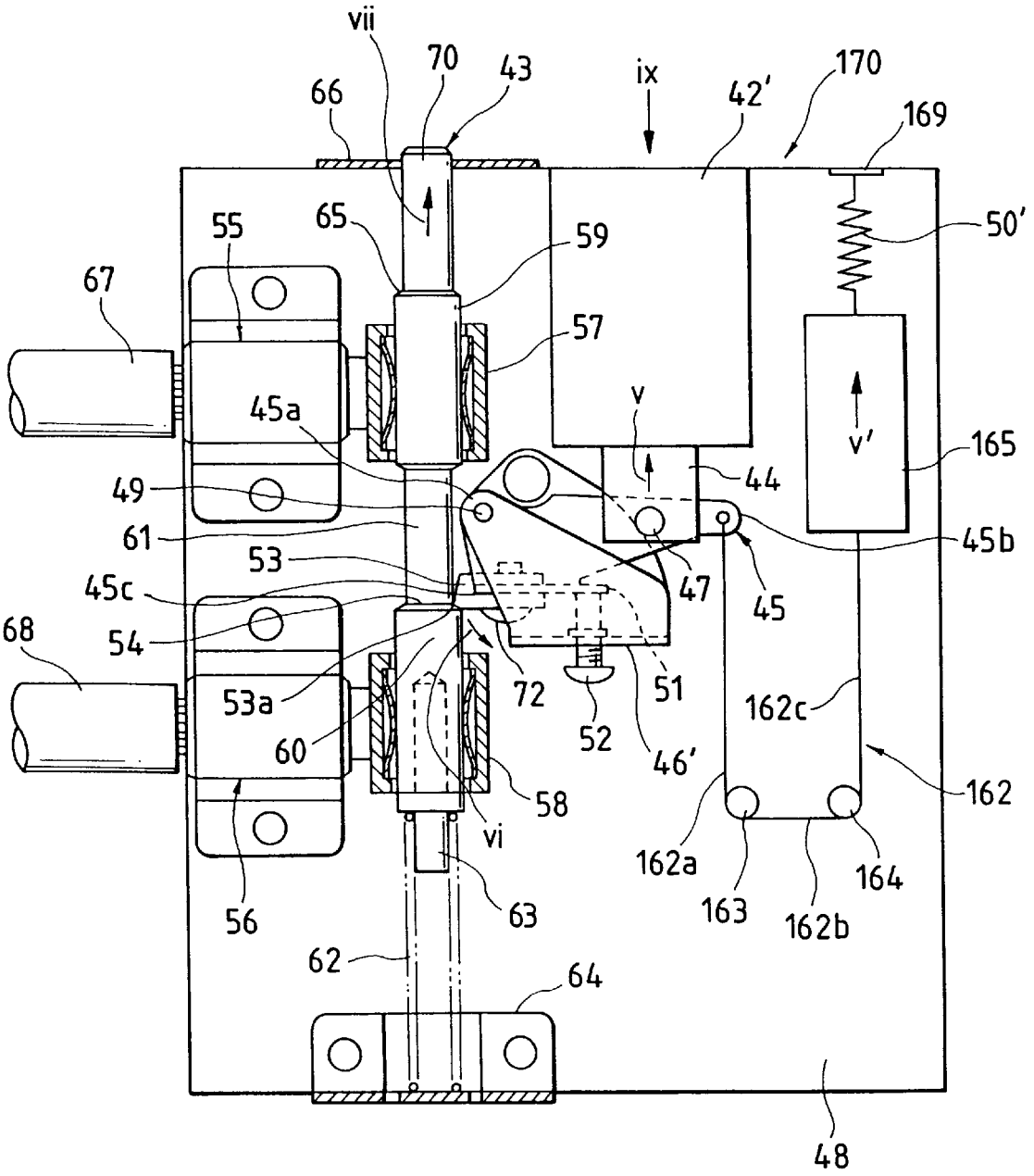
FIG. 19 is an internal structural drawing showing connecting condition in a power shut-off connector and a plan view with a partial sectional view as a fifth embodiment of the present invention.
Figure 20:
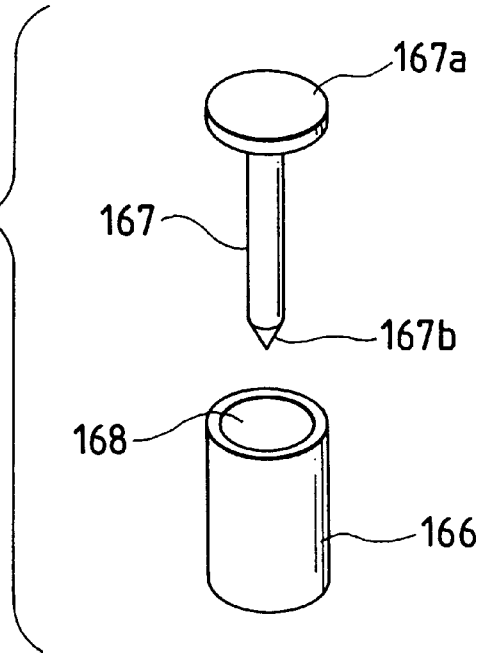
FIG. 20 is an exploded perspective view showing an example of a support pin in FIG. 19.
Figure 21:
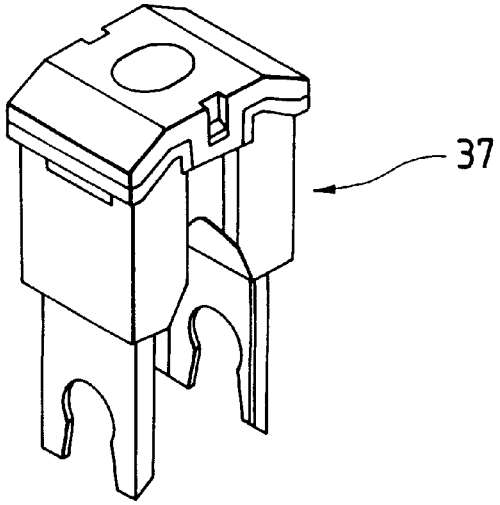
FIG. 21 is an exploded perspective view showing FL that has conventionally been employed.
Figure 22:
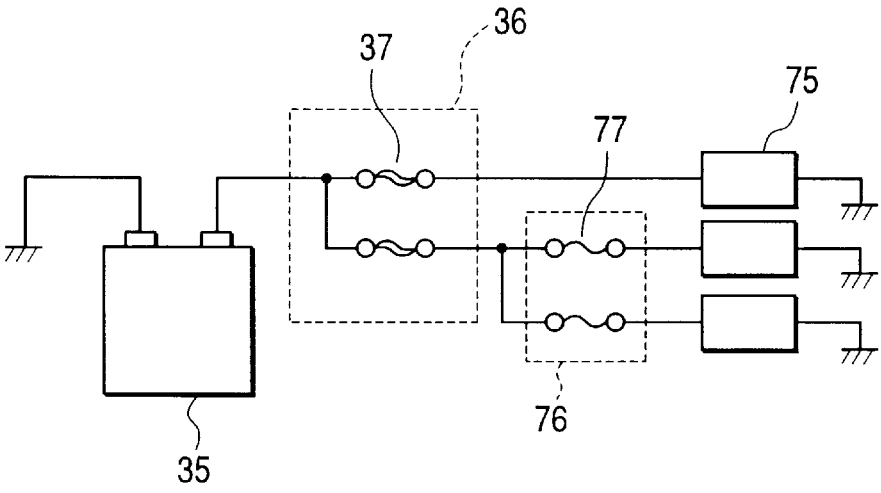
FIG. 22 is a circuit diagram illustrating a circuit in a vehicle using FL.
Figure 23:
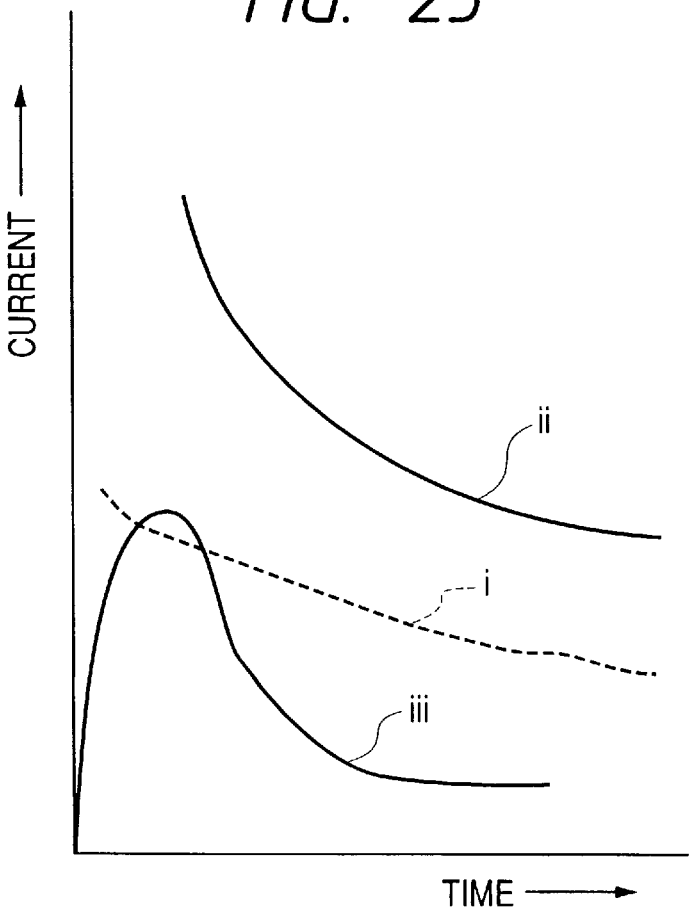
FIG. 23 is a graph showing fusing characteristics of the conventional FL.

The aforesaid power shut-off connector 1 is installed between the battery 35 and the FL box 36 or in place of the FL 37 of FIG. 20, for example. Although the connection between the moving pin 6 and the output-side (wire harness side) contact terminal 5 is broken according to the aforesaid embodiment of the invention, it may be so arranged that the connection between the input-side (battery side) contact terminal 3 is broken. With the provision of the stop flange 27, moreover, the other side mating groove 29 is not necessarily needed. The output-side mating groove 28 is necessary for making the plunger 21 of the solenoid 8 precisely engage with the mating groove (mating portion) 22 of the moving pin 6. Moreover, the moving pin 6 can be slid smoothly along the guide wall (not shown) of the housing body 20, for example. Further, two of the output-side contact terminals 5 for the input-side are provided so that power with respect to two power lines may be shut off. In place of the pressure welded portion 12 of the output-side contact terminal 5 connected to the single conductor 10, the FL 37 (FIGS. 18–19) may be connected directly thereto.

Figure 7:
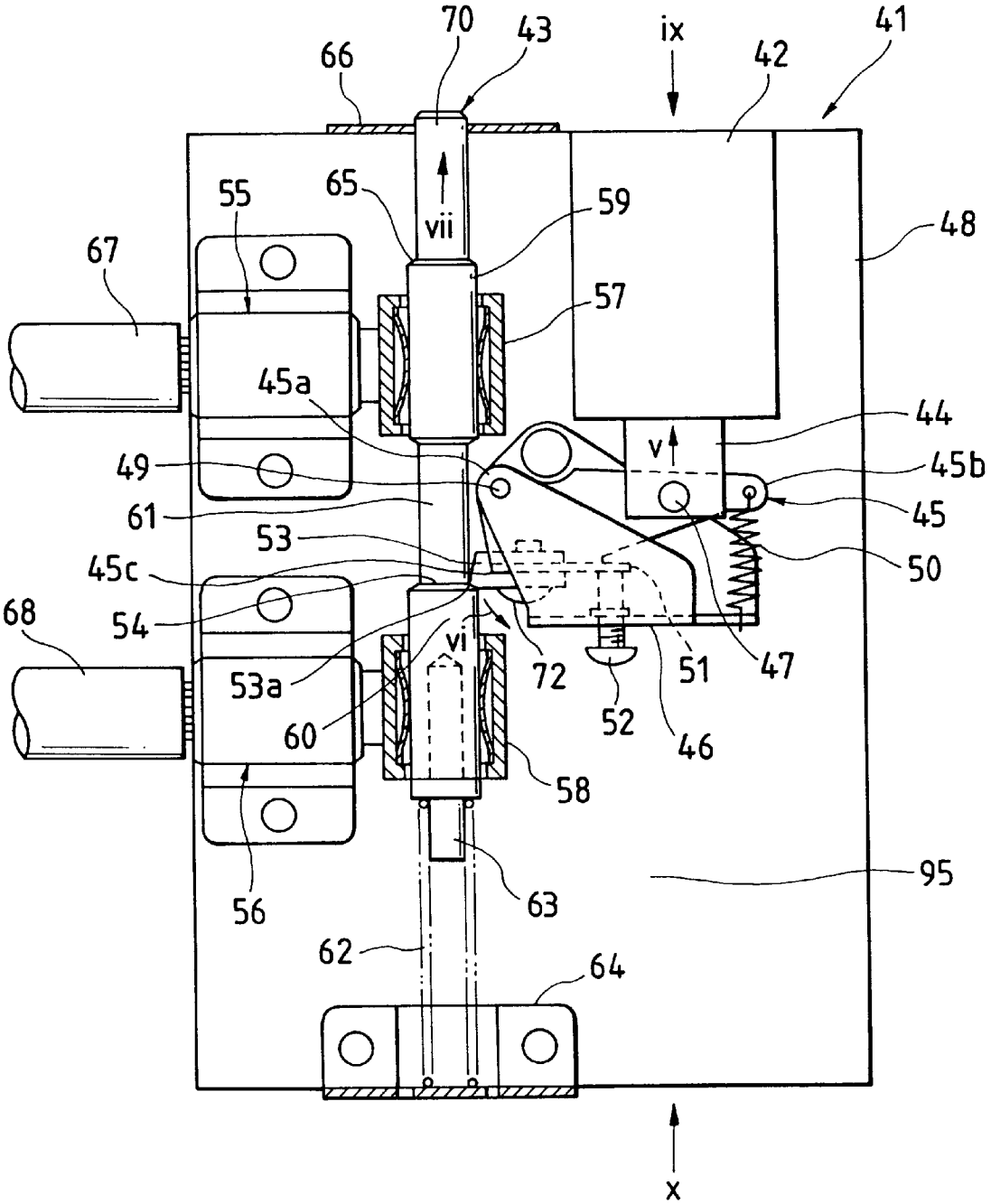
FIG. 7 is an internal structural drawing showing connecting condition in a power shut-off connector and a plan view with a partial sectional view as a second embodiment of the invention.
Figure 8:
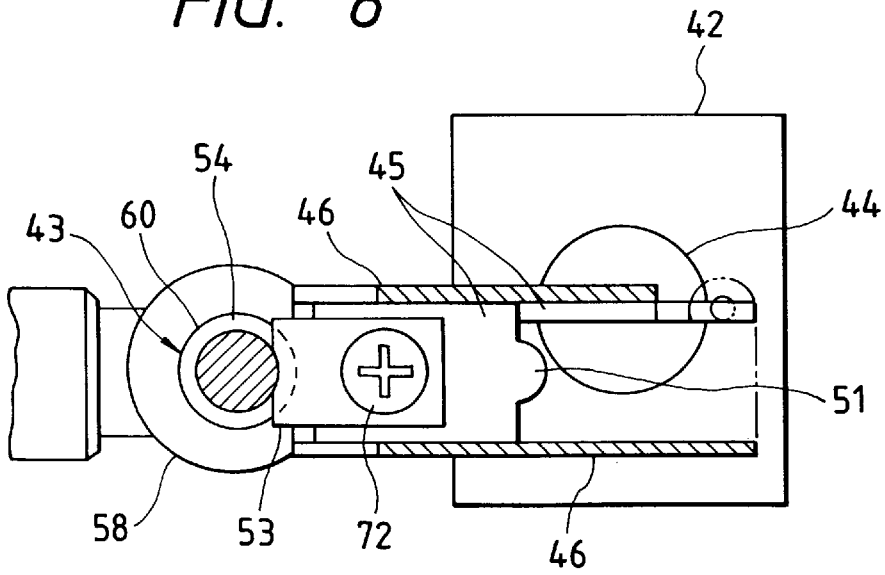
FIG. 8 is an elevational view showing the locking means of a moving pin.

FIGS. 7–8 show a power shut-off connector as a second embodiment of the invention.

Although this power shut-off connector 41 is similar to what has been described in the preceding embodiment of the invention as far as its principle is concerned, the former is characterized by disposing a solenoid 42 in parallel to a moving pin (shaft) 43 made of electroconductive metal, providing a plunger 44 with a locking member 45, and making a bracket 46 pivotally support the locking member 45, whereby retaining the moving pin 43 by the locking member 45.

The locking member 45 is substantially in the form of an inverted trapezoidal lever and directed to the moving pin 43 in such a manner as to meet the plunger 44 at right angles. In a position closer to the plunger (in the upper half portion of the locking member 45, for example) the longitudinal intermediate portion of the locking member 45 is pivotally coupled to the leading end portion of the plunger 44 with a pin 47. The solenoid 42 is positioned on the projecting side of the moving pin 43. The bracket 46 is fixed to a housing body 48. One end portion 45*a* of the locking member 45 is pivotally supported by the bracket 46 with a support pin 49 in the proximity of the moving pin 43. The other end portion 45*b* of the locking member 45 is urged by a helical tension spring 50 in the direction in which the plunger 44 is projected. In FIG. 7, the plunger 44 is kept projecting by the force of the helical tension spring 50.

The stop plate 51 of the intermediate portion of the locking member 45 is kept in contact with the tip of the backing bolt 52 of the bracket 46 on the tensile side (in the lower half portion of the locking member 45, for example) of the helical tension spring 50. Further, a plastic locking tip 53 is fixed to the leading end side of the locking member 45 with a male thread on the extended side of the stop plate 51. The tapered front face 53*a* of the plastic tip 53 mates with the tapered stepped mating portion (mating portion) 54 of the moving pin 43. The plastic tip 53 is replaceable in order to deal with its frictional wear caused by the sliding contact of the moving pin 43. Thus, the locked condition is smoothly released by the plastic tip 53.

The moving pin 43 has a pair of axial large-diameter portions 59, 60 coming in contact with the respective cylindrical contact portions 57, 58 of a pair of contact terminals 55, 56, and a small-diameter portion 61 formed in between the pair of large-diameter portions 59, 60, and the plastic tip 53 mates with the shoulder portion, that is, the stepped mating portion (mating portion) of the one-side (on the side of a compression coil spring 62) large-diameter portion 60.

A small-diameter plastic boss 63 for fixing the spring is provided at one end of the moving pin 43 and the compression coil spring 63 is resiliently installed between the boss 62 and a spring backing member 64. The other end of the moving pin 43 is exposed to the outside of the housing body 48. A stop plate 66 with respect to the shoulder of the other side large-diameter portion 59 of the moving pin 43, that is, a second stepped mating portion 65 is provided for the housing body 48. The contact terminals 55, 56 are each connected to input- and output-side electric wires 67, 68.

The moving pin 43 in the state of FIG. 7 is brought into contact with the contact terminals 55, 56, so that electricity can be supplied from the power line 67 via the moving pin 43 to the load line 68. The solenoid 42 is projected and the plastic tip 53 of the locking member 45 causes the moving pin 43 to be locked against the force of the compression coil spring 62. The locking member 45 is pulled by the tension helical spring 50 opposite to the plunger 44 in order to make the bolt 52 of the bracket 46 receive the tensile strength.

When the solenoid 42 receives an external signal and is turned on in the state of FIG. 7, the plunger 44 is pulled into the solenoid 42 as indicated by an arrow v and the locking member 45 is pivoted in the direction of the output-side cylindrical contact portion 58 (the direction indicated by an arrow vi) centering on the support pin 49, that is, in the direction in which the plunger is moved back and forth against the force of the helical tension spring 50. Consequently, the plastic tip 53 is separated from the stepped mating portion 54 of the moving pin 43 and the moving pin 43 is slidingly moved by the force of the compression coil spring 62 in the direction of the input-side cylindrical contact portion 57 (the direction indicated by an arrow vii). Consequently, the contact between the output-side cylindrical contact portion 58 and the large-diameter portion 60, and the contact between the input-side cylindrical contact portion 57 and the large-diameter portion 59 are broken and so is the circuit.

The moving pin 43 is straightly moved by making the small diameter portion (indicated by 70) of its leading end side move along the stop plate 66 of the housing body 48 and stopped when the shoulder portion of the large-diameter portion 59, that is, the second stepped mating portion 65 is brought into contact with the stop plate 65. The leading end portion 70 of the moving pin 43 is projected outward. The locking member 45 is restored to the original position of FIG. 7 because of the force of the helical tension spring 50 by press-fitting the leading end portion 70 and turning off the solenoid 42; thus, the circuit is reset.

A compression spring (not shown) instead of the helical tension spring 50 may be installed in the solenoid 42 in order to project the plunger 44. It is also acceptable to provide the mating portions 28, 29 of the moving pin 6 shown in the first embodiment of the invention (FIG. 1) and the ball plungers 30 for the mating portions in the second embodiment thereof.

Moreover, a motor in place of the solenoid 42 as a driving means may be used to drive the plunger 44 by means of gear driving.

According to the second embodiment of the invention, the width of the power shut-off connector 41 is reducible since the solenoid 42 is not projected sidewise contrary to the preceding example. Moreover, greater locking force is available as the driving of the locking member 45 is based on this principle to ensure that the locked condition is released with small force. Further, it is unnecessary to increase the size of the solenoid large-sized per se as an arrangement of breaking a large current, whereby the power shut-off connector is prevented from being large-sized.

FIGS. 9–16 show a power shut-off connector as a third embodiment of the invention.

Figure 9:
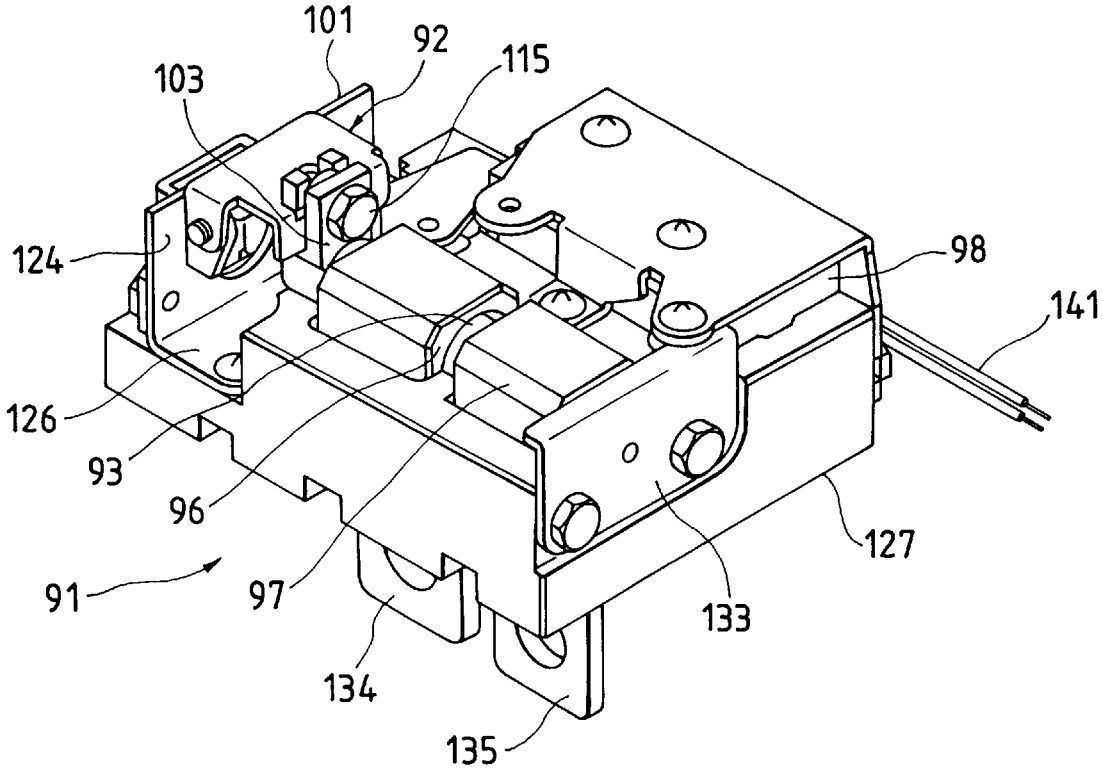
FIG. 9 is an overall perspective view showing a power shut-off connector as a third embodiment of the invention.

This power shut-off connector (power cut relay) 91 is similar to the power shut-off connector 41 (FIG. 7) in the second embodiment of the invention and by setting the position of a locking member (lever) 92 not in the intermediate portion but on the leading end side of an electroconductive moving pin (shaft) 93 as shown in FIG. 9, the moving pin 93 is shortened. Further, the power shut-off connector per se can be made compact by making it possible to house a compression coil spring (release spring) 94 in the moving pin 93 as shown in FIG. 10.

The power shut-off connector 41 (FIG. 7) per se is large-sized according to the second embodiment of the invention due to the fact that the moving pin 43 is long; the compression coil spring 62 is greatly projected outward; and a large dead space 95 is produced on the plunger projecting side of the solenoid 42. However, such a dead space (95 of FIG. 7) is obviated and a power shut-off connector per se is made compact in the third embodiment of the invention as shown in FIG. 9 by decreasing the pitch of a pair of cylindrical contact portions 96, 97 which are positioned outside the moving pin 93, disposing a solenoid 98 close to the sides of both cylindrical contact portions 96, 97, disposing the locking member 92 in the proximity of the leading end portion side of the moving pin 93, and housing the compression coil spring 94 in the moving pin 93.

Figure 11:
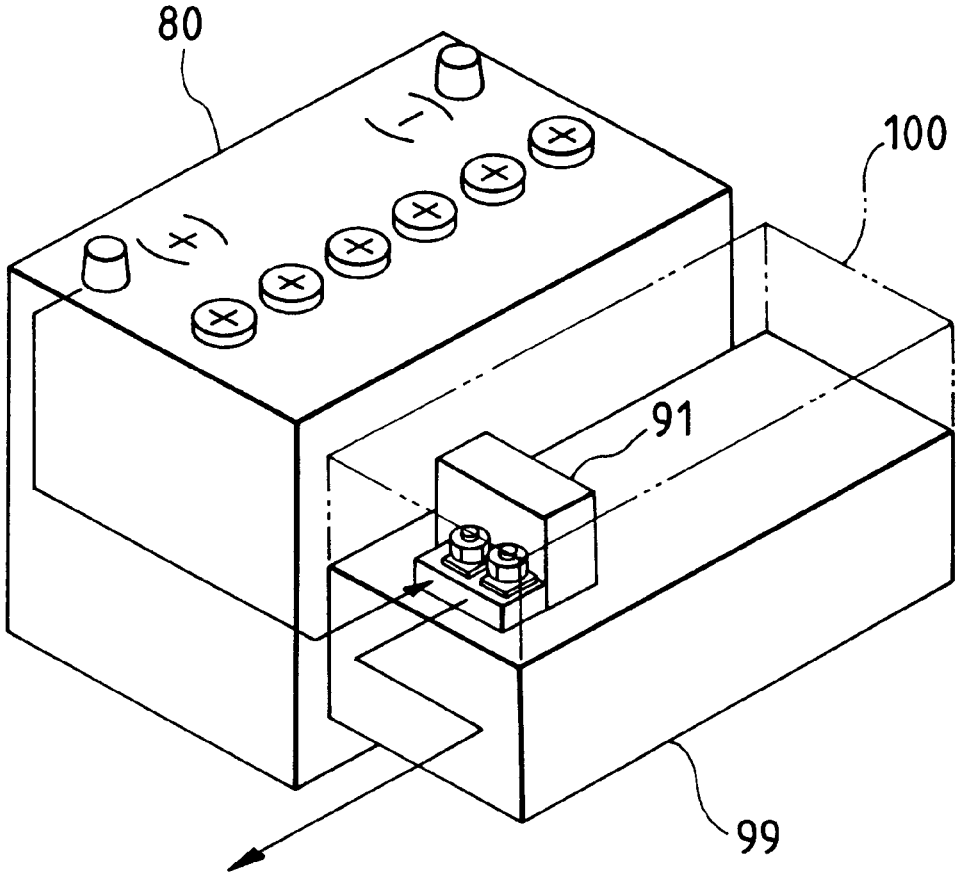
FIG. 11 is a perspective view showing a place where the power shut-off connector is applied.

As shown in FIG. 11, the power shut-off connector 91 can thus be housed within the cover 100 of a relay box 99 adjacent to the battery 80, for example.

Figure 10:
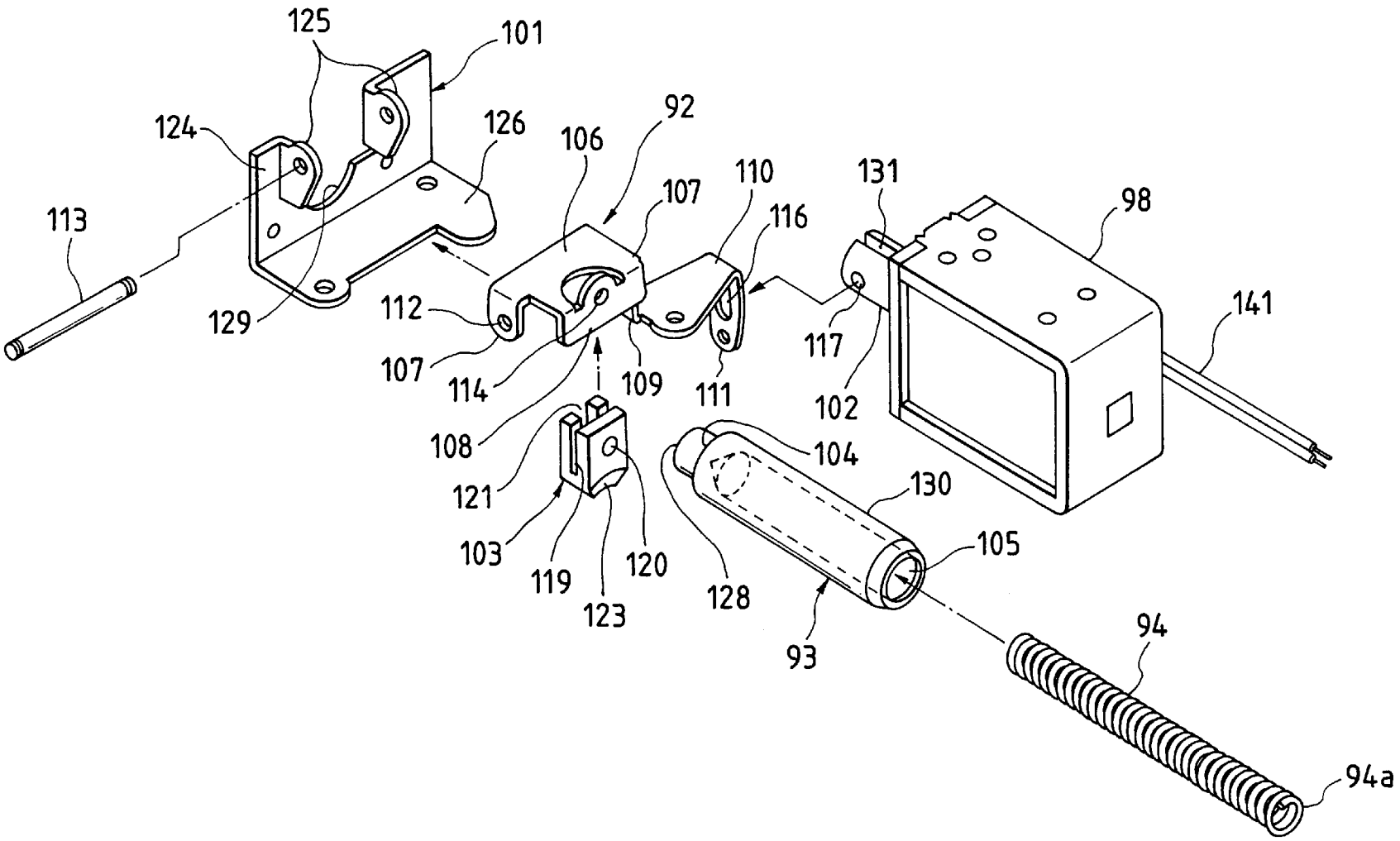
FIG. 10 is an exploded perspective view showing the principal part.

As shown in FIGS. 9–10, further, one side of the aforesaid locking member 92 is axially and pivotally supported with a bracket 101, whereas the other side thereof is coupled to the plunger of the solenoid 98. A plastic locking tip 103 is mounted on the locking member 92 and a stepped mating portion 104 on the leading end side of the moving pin 93 is retained at the leading end of the plastic tip 103.

In FIG. 9, the plastic tip 103 is positioned on the upper side of the moving pin 93 (in a direction opposite to the base of a housing body 127) where there is spatially sufficient room (because a dimension in the height direction of the power shut-off connector 91 is smaller than the longitudinal one thereof) and as the plastic tip 103 is pivoted upward when the locked condition is released, no hampering is caused to the locking member 92 including the plastic tip 103 and this is spatially advantageous.

A housing chamber (housing portion) 105 is formed in the moving pin 93 so that the compression coil spring 94 can be inserted in and the moving pin 93 is urged by the compression coil spring 94 toward the plastic tip 103.

The locking member 92 includes as shown in FIG. 10 a first horizontal base portion 106, a pair of perpendicular support portions 107 each provided on both sides of the first base portion 106, a perpendicular tip mounting portion (locking portion) 108 provided at the rear end of the first base portion 106, a perpendicular coupling portion 109 provided on one side of the first base portion 106, a second base portion 110 which is horizontally formed out of the coupling portion 109 and forms a step with respect to the first base portion 106, and a perpendicular solenoid coupling portion 111 provided on one side of the second base portion 110. The locking portion (108) may be a portion for retaining the moving pin 93 without using the plastic tip 103.

The pair of support portions 107 have support pin through-holes 112 and are mounted in the bracket 101 with a support pin 113. A fixing hole 114 is formed in the tip mounting portion 108 and the plastic tip 103 is fixed thereto with a bolt 115 (FIG. 9) and a nut (not shown). A perpendicular slot 116 is formed in the solenoid coupling portion 111 and lateral hole 117 is formed in the plunger 102. The solenoid coupling portion 111 is pivotally coupled to the plunger 102 by passing a bolt 118 (FIG. 12) through the slot 116 and the lateral hole 117. The plunger 102 has a notch 131 for incorporating the solenoid coupling portion 111 therein. The solenoid coupling portion 111 is incorporated in the plunger 102 pivotally in the direction in which the plunger is moved back and forth.

The plastic locking tip 103 is similar to what has been referred to in the preceding example and has a slit 119 for use in inserting the tip mounting portion 108, a fixing hole 120 perpendicular to the slit 119, a nut fitting groove 121 formed opposite to the fixing hole 120, a curved leading end face 122 (FIG. 14) extending along the peripheral portion of the moving pin 93, and a tapered retaining face 123 (FIG. 13) following the curved leading end face 122.

The bracket 101 (FIG. 10) has a pair of lateral bearing portions 125 in the perpendicular base portion 124 and fixed in a horizontal base portion 126 to the housing body 127 (FIG. 9) of the power shut-off connector 91. A cutaway portion 129 through which a small-diameter portion 128 on the leading end side of the moving pin 93 can be passed is formed between the pair of bearing portions 125 of the perpendicular base portion 124 and the stepped mating portion 104 of the moving pin 93 can be brought into contact with the peripheral edge of the cutaway portion 129.

The moving pin 93 has the guiding small-diameter portion 128 projecting like a boss on its leading end side and the small-diameter portion is followed by the stepped mating portion. A large-diameter portion 130 as a contact portion perpendicularly follows the stepped mating portion 104 and no narrow part as in the second embodiment of the invention is formed in the intermediate portion of the large-diameter portion 130.

The housing chamber 105 of the moving pin 93 is made by hollowing out and the length of the housing chamber 105 is set shorter than the most compressed length of the compression coil spring 94, the base portion 94*a* of the compression coil spring 94 being projected outside the housing chamber 105. The arrangement of providing the housing chamber 105 with respect to the compression coil spring 94 in the moving pin 93 is applicable to the first, second or fourth embodiment of the invention, which will be more fully discussed hereinafter.

As shown in FIG. 9, the solenoid 98 is fixed to the housing body 127 and the base portion 94*a* of the compression coil spring 94 (FIG. 10) is supported with a spring backing plate 133. Lead wires 141 of the solenoid 98 are connected to the ECU 78 (FIG. 5) of the air bag, for example. The pair of cylindrical contact portions 96, 97 follow plate-like terminals 134, 135 and the one-side plate-like terminal 134 follows the battery 80 (FIG. 5) and the like, whereas the other side plate-like terminal 135 follows the starter 81 (FIG. 5) and the like.

Figure 12:
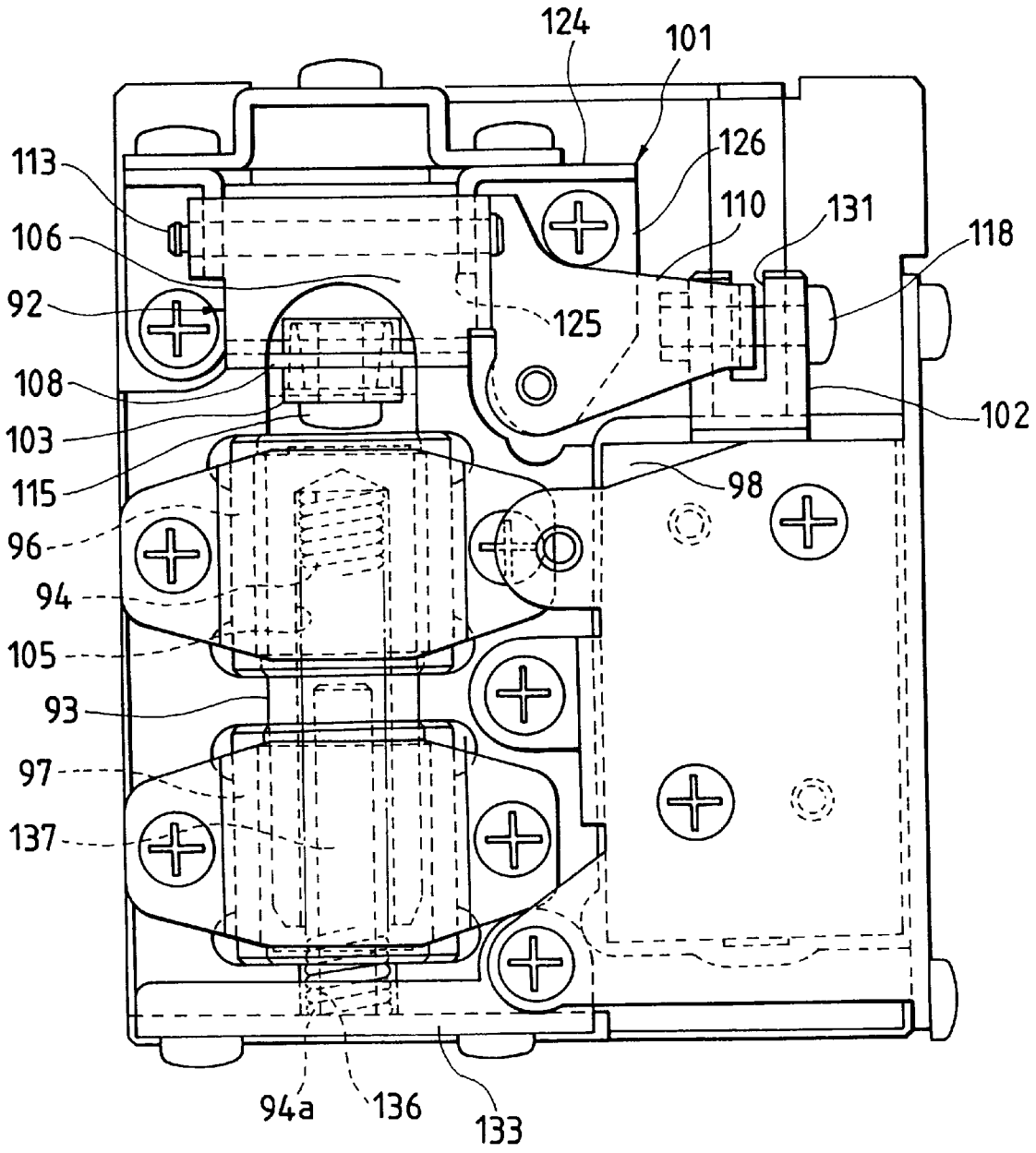
FIG. 12 is a plan view showing the power shut-off connector.
Figure 13:
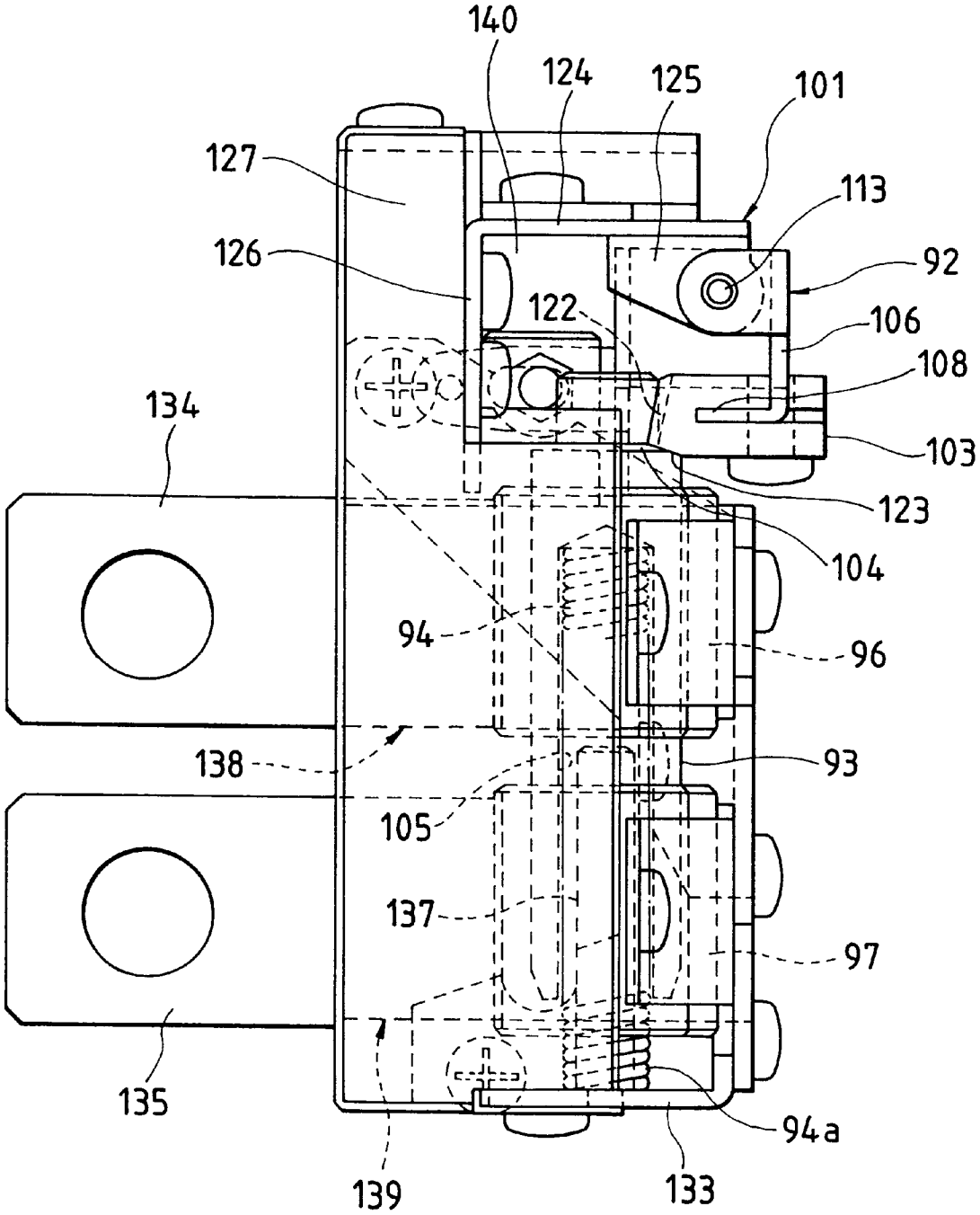
FIG. 13 is a side view showing the power shut-off connector.
Figure 14:
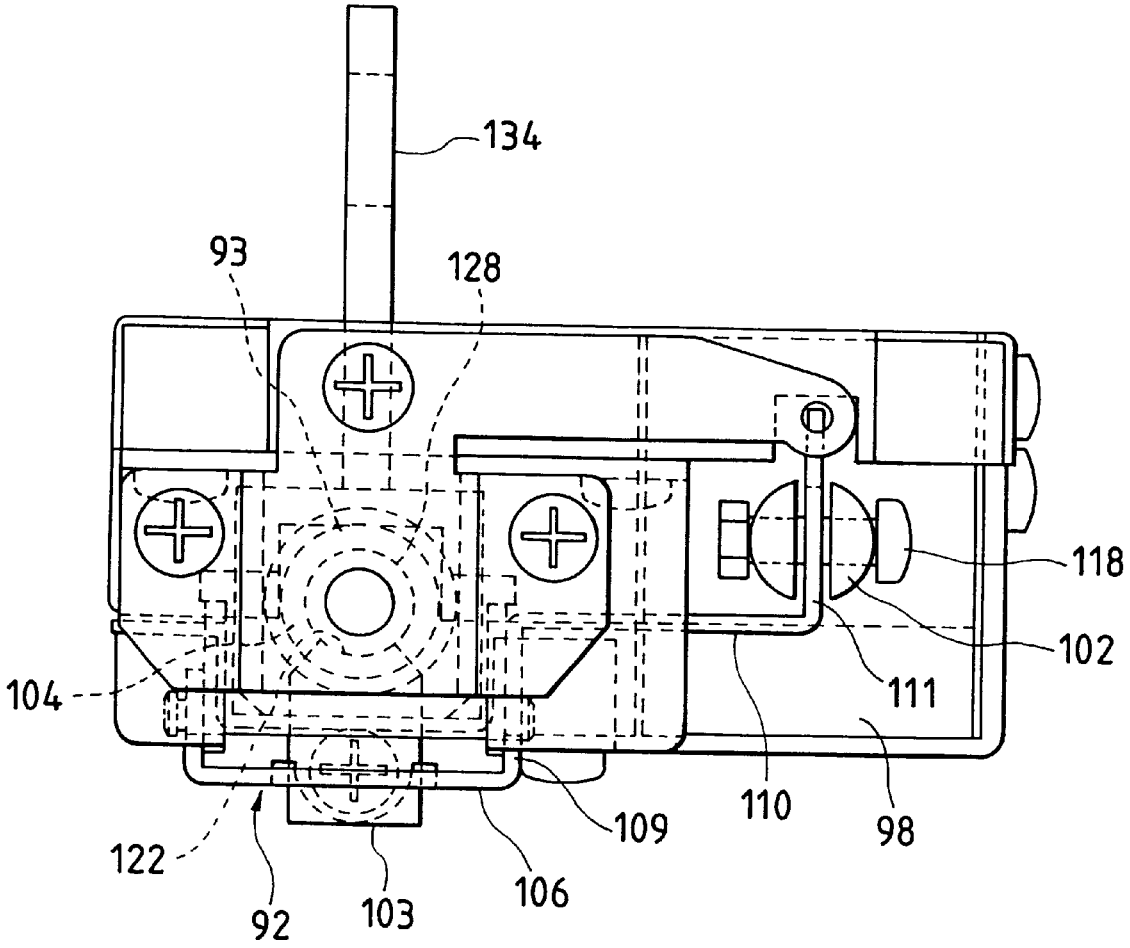
FIG. 14 is an elevational view showing the power shut-off connector.

As shown in more detail in FIGS. 12–14, the construction of the power shut-off connector 91 is such that a positioning guide pin 137 is fitted in the inner-diameter space 136 of the compression coil spring 94 and the positioning guide pin 137 is fixed to the spring backing plate 133. The plastic tip 103 of the locking member 92 is kept mating with the stepped mating portion 104 on the leading end side of the moving pin 93 in such a state that the compression coil spring 94 has been compressed in the moving pin 93. The stepped mating portion 104 has a tapered mating face (104) along the retaining face 123 of plastic tip 103. When the moving pin 93 is brought into contact with both cylindrical contact portions 96, 97, both plate-like terminals 134, 135 (FIG. 13) are connected together via the moving pin 93. Contact terminals 138, 139 are constituted of the cylindrical contact portions 96, 97 and the plate-like terminals 134, 135. The plunger 102 of the solenoid 98 is urged by an internal compression spring (not shown) and becomes completely extended.

As shown in FIG. 13, the plastic locking tip 103 is positioned in a manner perpendicular to the moving pin 93 and the first base portion 106 of the locking member 92 is positioned in parallel to the moving pin 93 and also in the upper portion of a space 140 on the projecting side of the moving pin (in a direction opposite to the base of the housing body 127). The bracket 101 and the left half portion (106–108) of the locking member 92 are as shown in FIGS. 12–13 arranged on the projecting side of the moving pin 93, so that the power shut-off connector 91 is made compact by effectively utilizing the space 140 on the projecting side thereof. As shown in FIG. 12, the plastic tip 103, the first base portion 106 and the bearing portion 125 of the bracket 101 are linear symmetrical about the axis of the moving pin 93.

The second base portion 110 of the locking member 92 is positioned on the side of the first base portion 106 and the solenoid 98 is positioned on the side of the moving pin 93, that is, in a manner adjacent to the side of the pair of cylindrical contact portions 96, 97, the leading end portion of the plunger 102 and the solenoid coupling portion 111 on one end side of the second base portion 110 are coupled with the bolt 118.

A detailed description of the remaining arrangement in FIGS. 12–14 will be omitted by giving like reference numerals of FIGS. 9–10.

Figure 15:
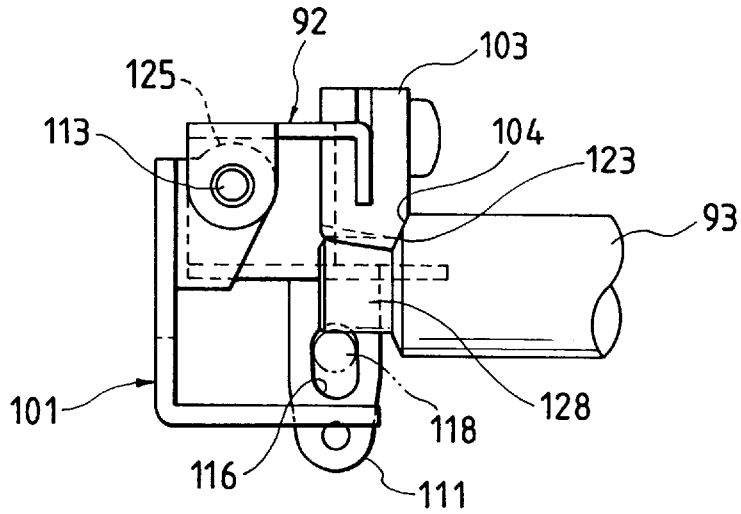
FIG. 15 is a side view showing a state in which the moving pin is retained by a locking member.
Figure 16:
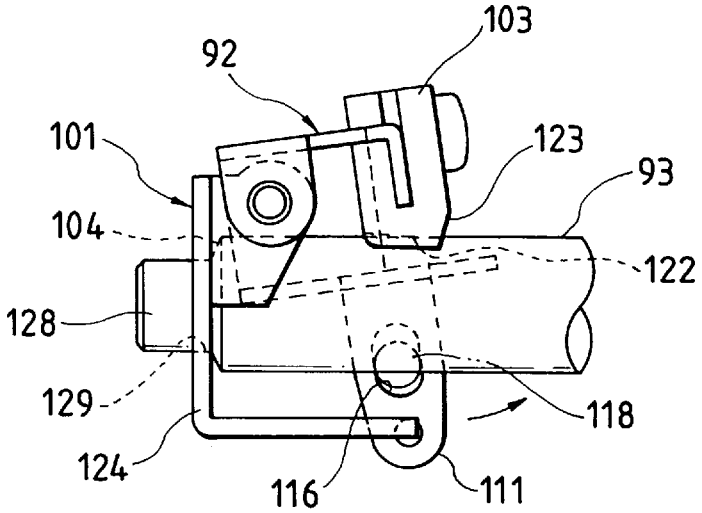
FIG. 16 is a side view showing the initial state in which the retained condition is released.
Figure 17:
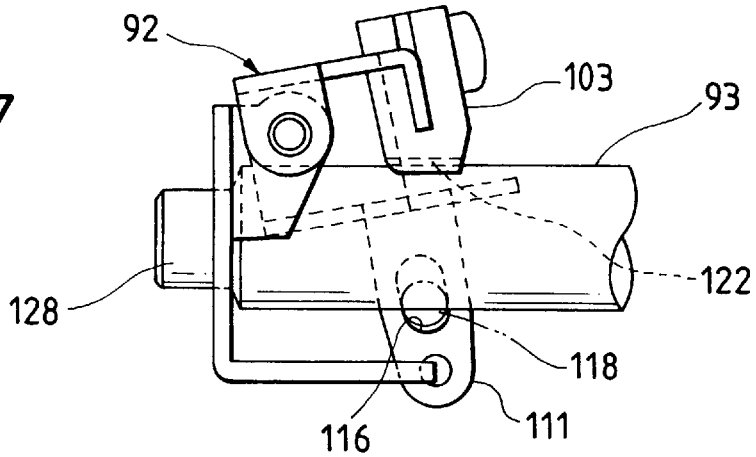
FIG. 17 is a side view showing a state in which the retained condition is completely released.

FIGS. 15–17 show the function of the locking member 92.

FIG. 15 corresponds to FIG. 13 in that the retaining face 123 of the plastic tip 103 is brought into contact with the stepped mating portion 104 on the leading end side of the moving pin 93 and used to retain the moving pin 93 against the urging force of the compression coil spring 94 (FIG. 13). The plunger 102 (FIG. 12) is coupled to the slot 116 of the solenoid coupling portion 111 with the bolt 118. The solenoid coupling portion 111 is extended in a manner perpendicular to the moving pin 93. The locking member 92 is pivoted on the bracket 101 with the support pin 113, and the support pin 113, the plastic tip 103 and the slot 116 are so positioned that each of these parts makes an apex of a triangle.

When a signal is received from the ECU 78 of the air bag in FIG. 5, for example, the solenoid 98 (FIG. 12) is actuated and causes the plunger 102 (FIG. 12) to b e attracted, whereby the locking member 92 starts pivoting in the direction of an arrow as the solenoid coupling portion 111 is pulled by the plunger 102 (FIG. 12) as shown in FIG. 16.

The plastic tip 103 is pivoted to escape in the diametric direction of the plunger 102, that is, that of the moving pin 93. The third embodiment of the invention is different from the second embodiment thereof in that the plastic tip 53 (FIG. 7) is pivoted in the backward direction of the plunger 44 (FIG. 7). The stepped mating portion (mating face) 104 on the leading end side of the moving pin 93 is removed from the retaining face 123 of the plastic tip 103, so that the moving pin 93 is projected forward by the urging force of the compression coil spring 94 (FIG. 13) along the curved leading end face 122 of the plastic tip 103. Thus, the cylindrical contact portion 97 on the base side of the moving pin of FIG. 13 is set free from contacting the moving pin 93 and the circuit is instantly broken. The stepped mating portion 104 of the moving pin 93 is brought into contact with the perpendicular base portion 124 of the bracket 101 and the small-diameter portion 128 on the leading end side is projected forward from the cutaway portion 129 of the base portion 124 and supported.

A gap is slightly produced between the curved leading end face 122 of the plastic tip 103 and the moving pin 93 in the maximum pivotal position of the locking member 92 of FIG. 17. As the locking member 92 is pivoted, the slot 116 of the solenoid coupling portion 111 is guided by the bolt 118 and moved. The operation of resetting the moving pin 93 may be performed manually by forcing the small-diameter portion 128, for example.

The locking member 92 according to the third embodiment of the invention is such that as shown in FIGS. 9–10 the base portions 106, 107 (FIG. 10) are positioned in parallel to each other above the horizontal moving pin 93 and the space above the moving pin 93 has sufficient room in comparison with the space on the lateral side of the moving pin 93. Consequently,the power shut-off connector 91 can be made compact because the space occupied by the locking member 92 is smaller than what is provided according to the second embodiment of the invention wherein the lengthy locking member 45 is disposed laterally on the lateral side of the moving pin 43. Moreover, power is shut off with great reliability because the locking member 92 and the support pin 113 (FIG. 10) have a highly reliable positional relationship as in the second embodiment of the invention to ensure that the moving pin 93 can be retained and released from being retained.

Figure 18:
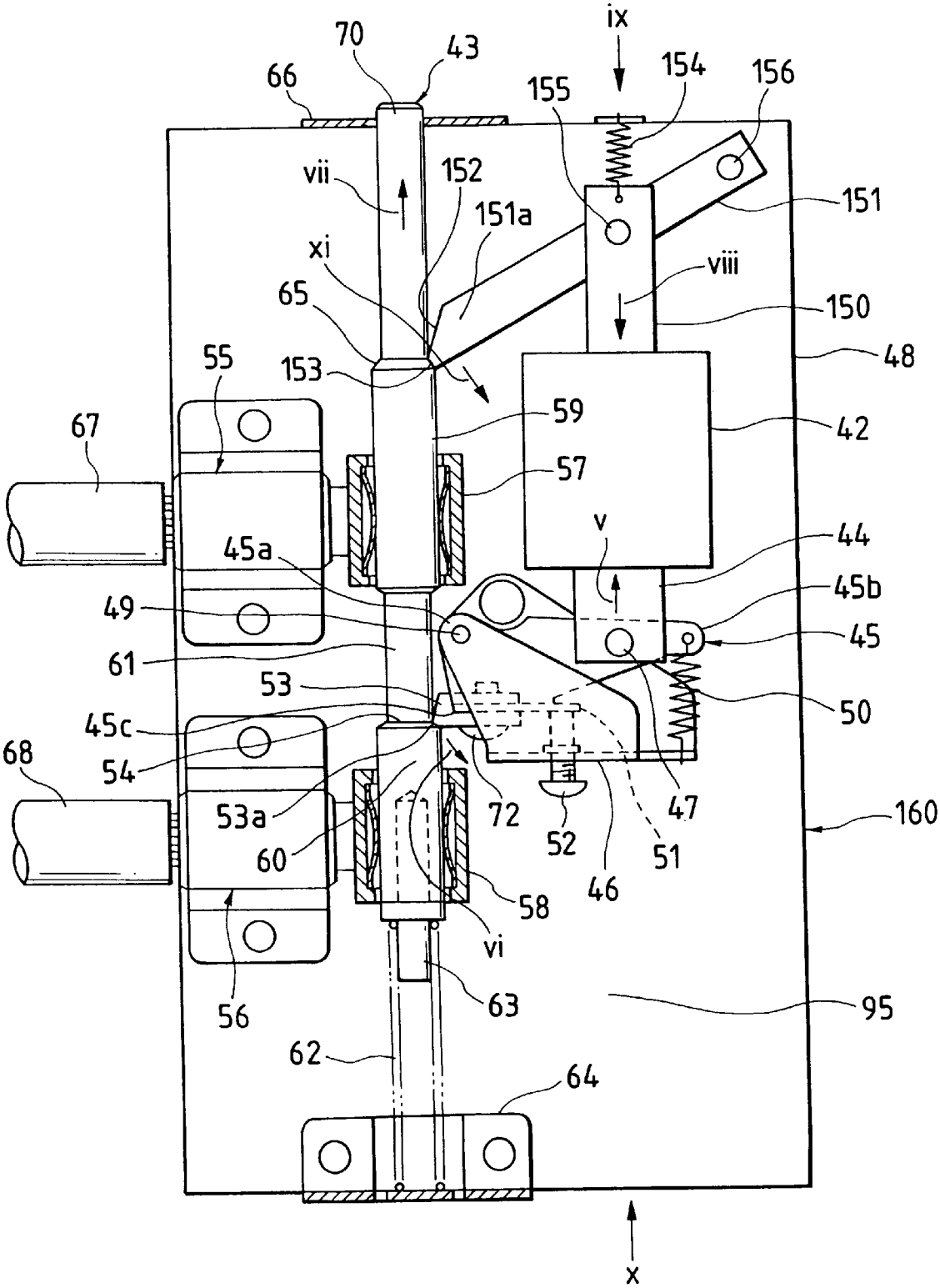
FIG. 18 is an internal structural drawing showing connecting condition in a power shut-off connector and a plan view with a partial sectional view as a fourth embodiment of the invention.

FIG. 18 shows a power shut-off connector as a fourth embodiment of the invention.

A power shut-off connector 160 according to this embodiment of the invention is such that the construction of the second embodiment thereof is so improved as to prevent malfunction arising from vehicular vibration and the like. This embodiment of the invention is intended to obviate this fear.

As component parts other than those featuring this embodiment of the invention are similar to those referred to in the second embodiment thereof (FIG. 7), a detailed description will be omitted by giving like reference numerals to the remaining arrangement in FIG. 18.

The pair of large-diameter portions 59, 60 of the moving pin 43 are brought into contact with the cylindrical contact portions 57, 58 of the respective contact terminals 55, 56 and the shoulder portion of the one-side large-diameter portion 60, that is, the first stepped mating portion 54 is retained by the plastic tip 53 at the leading end of the locking member 45 in that state. The stop plate 51 of the locking member 45 is extended toward the rear side of the plastic tip 53 and brought into contact with the backing bolt 52, whereby the locking member 45 is prevented from pivoting in a direction opposite to the direction (of the arrow vi) of releasing the locked condition with the support pin 49 as a fulcrum. Therefore, the plunger 44 of the solenoid 42 is never moved in the pulling out direction viii(a direction opposite to the direction of the arrow v) because of an impact.

This embodiment of the invention is characterized in that a vertical (longitudinal) pair of plungers (the first plunger 44 and a second plunger 150) are symmetrically provided for the solenoid 42; an operating signal of the solenoid 42 is used for simultaneously pulling the plungers 44, 150 into the solenoid 42 as shown by arrows v, viii); a locking arm 151 as a second locking member is coupled to the second plunger 150 situated opposite to the locking member 45; and the leading end portion 151a of the locking arm 151 can be mated with the shoulder portion of the front-side large-diameter portion 59 in the direction in which the moving pin 43 is actuated, that is, the second stepped mating portion (mating portion) 65.

The locking arm 151 is in the form of a long and narrow flat plate and the leading end portion of the locking arm 151 is a greatly tapered cutaway portion facing the small-diameter portion (70) on the leading end side of the moving pin 43. A portion opposite to this cutaway portion 152 is formed into a cutaway retaining face 153 which has substantially the same width and the same tilted angle as those of the second stepped mating portion 65 and is less tapered. The second plunger 150 is urged by a second helical tension spring 154 in the projecting direction and one end of the helical tension spring 154 is fixed to the leading end of the plunger 150, whereas the other end thereof is fixed to the housing body 48. The intermediate portion of the locking arm 151 is supported by a pin 155 on the leading end side of the plunger 150 and its base portion is supported by a pin 156 in the housing body 48, the locking arm 151 being integral with the plunger 150 and pivotal with the pin 156 of the base portion as a fulcrum.

Referring to FIG. 18, the second plunger 150 is urged by the helical tension spring 154 in the projecting direction and the locking arm 151 mates with the second stepped mating portion 65 of the moving pin 43 so as to retain the moving pin 43 together with the locking member 45. Even when the first plunger 44 is moved in the retracting direction (of the arrow v) because of the inertial force and has the retained condition of the locking member 45 released as a result of the impact applied to the power shut-off connector 160 as indicated by an arrow ix (or the arrow v) in that state, the force is exerted to the second plunger 150 in the projecting direction, that is, in a direction opposite to the first plunger 44 because of the external force, the locking arm 151 securely mates with the second stepped mating portion 65 to secure the locked condition of the moving pin 43.

Even when the second plunger 150 is moved in the retracting direction (of the arrow viii) and has the retained condition of the locking member 151 released as a result of the impact applied in the direction of the arrow x (or ix), the force is exerted to the first plunger 44 in the projecting direction and the locking member 45 securely mates with the first stepped mating portion 54 to secure the locked condition of the moving pin 43. Thus, the power shut-off connector 160 is surely prevented from malfunctioning.

When the solenoid 42 performs the normal operation on receiving an operating signal, the first and second plungers 44, 150 are simultaneously pulled into the solenoid 42 and the locking arm 151 and the locking member 45 are also simultaneously pivoted. Consequently, the retained condition of the moving pin 43 is released at the same time and moved by the urging force of the compression coil spring 62 in the direction of the arrow vii, and the electrical contact between the cylindrical contact portions 57, 58 of the contact terminals 55, 56 and the respective large-diameter portions 59, 60 of the moving pin 43 is released.

A detailed description will subsequently be given of the movement of the locking arm 151. When the solenoid 42 operates to have the plunger 150 pulled in the direction of the arrow viii against the urging force of the helical tension spring 154, the locking arm 151 is pivoted in the direction (of an arrow xi) in which the locked condition is released with the base portion of the pin 156 as a fulcrum. Thus, the retaining face 153 of the leading end portion 151*a* of the locking arm 151 is separated from the stepped mating portion 65 of the moving pin 43 and the retained condition is released. The moving pin 43 is moved by the urging force of the compression coil spring 62 in the direction of the vii and the leading end portion 151*a* of the locking arm 151 is positioned opposite to the large-diameter portion 59 or the small-diameter portion 61 of the moving pin 43.

The operation of resetting the locking condition, that is, that of supplying power results in turning off the solenoid 42 and by holding down the moving pin 43 against the force of compression coil spring 62, the second plunger 150 is pulled out by the force of the helical tension spring 154 and simultaneously the locking arm 151 is pivoted in the locking direction (opposite to the arrow xi), so that the state of FIG. 18 is restored.

The power shut-off connector 160 according to the fourth embodiment of the invention is prevented from malfunctioning (the releasing of the locked condition of the moving pin 43) because of an impact such as vibration during the traveling of the vehicle and since one solenoid 42 is required for two plungers 44, 150, it is possible to not only reduce the cost and size of the power shut-off connector 160 but also save the vehicle-side space in which the connector is mounted.

A pair of locking members 45 and a pair of brackets 46 in place of the locking arm 151 may be disposed symmetrically as the second locking member. Further, a compression coil spring (not shown) in place of the helical tension springs 50, 154 may also be installed in the solenoid 42.

FIG. 19 shows a power shut-off connector as a fifth embodiment of the invention.

The power shut-off connector according to this embodiment of the invention is intended to prevent the plunger 44 of the solenoid 42 from malfunctioning arising from vehicle vibration by improving the construction of the power shut-off connector according to the second embodiment thereof (FIG. 7), wherein like reference numerals are given to like component parts of FIG. 7 and the description thereof will be omitted.

The plunger 44 is coupled to the pin 47 with locking member 45, which is pivotally supported with a bracket 46' by means of the pin 49. In this case, the helical tension spring 50 of FIG. 7 according to the second embodiment of the invention is not installed between the bracket 46' and the plunger 44. The rear portion of the bracket 46' is considerably simplified and made compact in comparison with the bracket 46 of FIG. 7 according to the second embodiment of the invention.

The plastic locking tip 53 with respect to the stepped mating portion 54 of the moving pin 43 is provided on the leading end side 45*c* of the locking member 45 and one end of the wire 162 is coupled to the rear end portion 45*b* (where the helical tension spring 50 of FIG. 7 according to the second embodiment of the invention is installed) of the locking member 45. The first half portion 162*a* of the wire 162 is extended in parallel to the moving pin 43 and the intermediate portion 162*b* thereof is supported with two support pins 163, 164 and U-shaped. Further, the other end of the wire 162 is coupled to one end of a weight 165 featuring this embodiment of the invention in the same planar position as that of the leading end of the plunger 44 in the second half portion (turning side) 162*c*.

The weight 165 is made of metal and has substantially the same shape and weight as those of the plunger 44. Although it is acceptable that the weight 165 is different in shape from the plunger 44 and heavier than the plunger 44, the weight 165 is preferably as heavy as the plunger 44.

The weight 165 and second half portion 162*c* of the wire 162 are pulled by a helical tension spring 50' in the same direction as the direction in which the plunger 44 is pulled in (the direction of the arrow v). The rear end portion 45*b*, that is, the operating portion, of the locking member 45 is pulled by the first half portion 162*a* of the wire 162 in the projecting direction of the plunger 44 (the direction opposite to what is indicated by the arrow v). The plunger 44 is naturally kept being pulled in the projecting direction. The other end of a helical tension spring 50' is fixed to the wall portion 169 of the housing body 48. The helical tension spring 50' is supplied with the same urging force as that of the helical tension spring 50 of FIG. 7 according to the second embodiment of the invention. The plunger 44, the wire 162, the weight 165 and the helical tension spring 50' are disposed in parallel to one another.

Each of the support pins 163, 164 with respect to the wire 162 preferably has as shown in FIG. 20 a pivotal hollow casing 166, a head portion 167*a* and a shaft portion 167 for pivotally supporting the casing 166. The shaft portion 167 is inserted into the hollow portion 168 of the casing 166 and its leading end portion 167*b* is fixed to the housing body 48 of FIG. 19. A bearing (not shown) may be installed between the cylindrical body 166 and the shaft portion 167 and further it is acceptable to form a positioning groove (not shown) in the cylindrical body 166 with respect to the wire 162. In place of the support pins 163, 164, pulleys (not shown) may be used.

When either impact or vibration (smaller than the impact caused by vehicle collision) is applied during the traveling of the vehicle in the direction of the arrow ix or a direction opposite thereto in FIG. 19, inertial force acts in the pulling direction (of the arrow v) of the plunger 44. When the plunger 44 is pulled in the locking member 45 may be pivoted in the direction (of the arrow vi) in which the locked condition is released with the support pin 49 as a fulcrum.

Simultaneously when the pulling force acts on the plunger 44, the inertial force directed in the same direction (of an arrow v') as the direction in which the plunger 44 is pulled in acts on the weight 165, the plunger 44 is pulled in the projecting direction as the rear end portion 45*b*, that is, the operating portion of the locking member 45 is pulled in the locking direction (a direction opposite to the direction of the arrow v) via the wire 162. Consequently, the force applied to the plunger 44 is offset and the pull-in of the plunger 44 is hampered. Therefore, no malfunctioning of the solenoid 42 occurs and the locking condition is prevented from being unexpectedly released.

At the time of vehicle collision, the normal operation of the solenoid 42 according to an external signal causes the plunger 44 to be pulled in against the force of the helical tension spring 50', makes the locking member 45 pivot in the direction (of the arrow vi in which the locked condition is released, causes the moving pin 43 to instantly move in the projecting direction by means of the force of the compression coil spring 62, and breaks the contact between the cylindrical contact portions 57, 58 of the contact terminals 55, 56 and the respective large-diameter portions 59, 60 of the moving pin 43, whereby the power circuit is broken. As the locking member 45 is pivoted in the direction in which the locked condition is released, the first half portion 162*a* of the wire 163 is pulled in the direction of the arrow v and the second half portion 162*c* of the wire 162 together with the weight 165 is pulled in a direction opposite to the direction of the arrow v. The helical tension spring 50' together with the weight 165 is pulled in the same direction.

In this case, no inertial force in the pull-in direction acts on the plunger 44 against the vibration and impact applied from a direction other than the direction of the arrow ix (or a direction opposite thereto) and consequently there is no fear of malfunction. Moreover, the plunger 44 may be coupled directly to the wire 162 instead of coupling the wire 162 to the rear end portion 45*b* of the locking member 45. Further, a compression coil spring (not shown) in place of the helical tension spring 50' with respect to the plunger 44 may be disposed in the solenoid 42. In this case, the weight 165 is coupled to the wall portion 169 of the housing body 48 with a wire.

As set forth above, according to the present invention, since the external signal is usable for operating the driving means (solenoid) to ensure that the power circuit is instantly broken, vehicle safety is made improvable by dealing with the slight short of the wire harness that has not been dealt with by the FL and the abnormal condition derived from vehicle collision. According to the present invention, further, the position of the moving pin is accurately defined by mating the second mating portion of the moving pin with the urging mating means to ensure the making and breaking of the circuit. According to the present invention, further, the leverage of the locking member ensures that the moving pin is locked and released from being locked with small force, so that not only the solenoid but also the power shut-off connector itself is made compact.

According to the present invention, moreover, it is unnecessary to form a constricted mating portion in the intermediate portion of the moving pin with the effect of shortening the whole length of the moving pin and making the power shut-off connector compact. According to the present invention, the space on the projecting side of the moving pin is effectively utilized with the effect of unnecessitating the dead space on the side of the moving pin and making the power shut-off connector compact together with that of shortening the moving pin. According to the present invention, further, since the base portion and locking portion are positioned above the space on the projecting side of the moving pin, the space thereon is effectively utilized with effect of making the power shut-off connector compact. According to the present invention, further, housing the coil spring in the moving pin results in decreasing the space where the coil spring is placed, so that the power shut-off connector can be made compact.

According to the present invention, moreover, even when the locked condition of the moving pin is released by the one-side locking member as the one-side plunger is subjected to the inertial force in the direction in which the locked condition is released because any impact such as vibration is applied to the power shut-off connector during the traveling of the vehicle, the other side plunger receives force in the locking direction because of the impact and the other side locking member makes the moving pin tightly locked to ensure that the power shut-off connector is prevented from malfunctioning. According to the present invention, further, even when the locked condition of the moving pin is released by the one-side locking member because any impact such as vibration is applied to the power shut-off connector during the traveling of the vehicle, the plunger is pulled by the wire in the locking condition, whereby the malfunction of the plunger, that is, its locked condition is prevented from being unexpectedly released.

According to the present invention, moreover, the mating of the less hard plastic tip with the hard moving pin ensures the locked condition of both. Further, maintenance is facilitated as the plastic tip is replaceable. According to the present invention, the moving pin can be moved back and forth smoothly as the moving pin is supported with the cylindrical contact portion. Since the provision of the sliding means for the moving pin in the housing body is not particularly necessary, the power shut-off connector itself can be made compact. As spring contact in the cylindrical contact portion is possible unlike an ordinary relay contact, the power shut-off connector is fit for strong current connection and besides due to lower contact resistance, heat generation is suppressed.

What is claimed is:

1. A power shut-off connector comprising:

a plurality of an input and an output side contact terminals;

a slidable electroconductive moving pin having at least one end portion, said pin being brought into contact with the plurality of contact terminals in a plurality of places in an axial direction;

a mating portion provided with the moving pin at said end portion thereof;

a retaining member which interfaces with the mating portion, said retaining member being provided opposite said end portion of said pin;

urging means for urging the moving pin in the axial direction; and driving means for releasing an engagement between the mating portion and the retaining member by receiving an external signal.

2. A power shut-off connector according to claim 1, wherein the driving means is a plunger for a solenoid.

3. A power shut-off connector according to claim 2, wherein one side of a locking member serving as the retaining member is coupled to the plunger of the solenoid, an other side of the locking member is pivotally supported with a bracket, and the locking member is capable of mating with the mating portion of the moving pin.

4. A power shut-off connector according to claim 3, wherein the mating portion is provided in a tip end portion of the moving pin.

5. A power shut-off connector according to claim 4, wherein the locking member and the bracket are disposed opposite to, and on a projecting side of the moving pin and the solenoid is disposed on a side of the moving pin.

6. A power shut-off connector according to claim 5, wherein the locking member includes a solenoid coupling portion which is pivotal in a direction in which the plunger is moved back and forth, a base portion extending in a direction perpendicular to the solenoid coupling portion, and a locking portion which is perpendicularly provided for the base portion.

7. A power shut-off connector according to claim 3, wherein the locking member has a plastic tip mating with the mating portion.

8. A power shuter-off connector according to claim 1, wherein each of said contact terminals have cylindrical contact portions coming in contact with the moving pin.

9. A power shut-off connector according to claim 1, wherein said retaining member includes at least one support pin, and said support pin of the retaining member is offset from a path of the slidable electroconductive moving pin.

10. A power shut-off connector, comprising:

a plurality of an input and an output side contact terminals;

a slidable electroconductive moving pin brought into contact with the plurality of contact terminals in a plurality of places in an axial direction;

a mating portion provided with the moving pin;

a retaining member which interfaces with the mating portion;

urging means for urging the moving pin in the axial direction; and driving means for releasing an engagement between the mating portion and the retaining member by receiving an external signal;

wherein said urging means comprise a coil spring, and said power shut-off connector further comprises:

a housing portion for accommodating the coil spring the housing portion being formed in the moving pin.

11. A power shut-off connector comprising:

a plurality of an input and an output contact terminals;

a slidable electroconductive moving pin having at least one end portion, said pin being brought into contact with the plurality of contact terminals in a plurality of places in an axial direction;

a mating portion provided with the moving pin at said end portion thereof;

a retaining member which interfaces with the mating portion, said retaining member being provided opposite said end portion of said pin;

an urging member which urges the moving pin in the axial direction; and a driving device which releases an engagement between the mating portion and the retaining member by receiving an external signal, wherein the urging member is separate from the driving device.

12. The power shut-off connector according to claim 11, wherein the driving means is a plunger for a solenoid, and one side of a locking member serving as the retaining member is coupled to the plunger of the solenoid, an other side of the locking member is pivotally supported with a bracket, and the locking member is capable of mating with the mating portion of the moving pin.

13. The power shut-off connector according to claim 12, wherein the mating portion is provided in a tip end portion of the moving pin.

14. The power shut-off connector according to claim 13, wherein the locking member and the bracket are disposed opposite to, and on a projecting side of the moving pin and the solenoid is disposed on a side of the moving pin.

15. The power shut-off connector according to claim 14, wherein the locking member includes a solenoid coupling portion which is pivotal in a direction in which the retaining member is moved back and forth, a base portion extending in a direction perpendicular to the solenoid coupling portion, and a locking portion which is perpendicularly provided for the base portion.

16. The power shut-off connector according to claim 11, wherein each of said contact terminals have cylindrical contact portions coming in contact with the moving pin.

17. The power shut-off connector according to claim 11, wherein said retaining member includes at least one support pin, and said support pin of the retaining member is offset from a path of the slidable electroconductive moving pin.

18. A power shut-off connector comprising:

a plurality of an input and an output contact terminals;

a slidable electroconductive moving pin brought into contact with the plurality of contact terminals in a plurality of places in an axial direction;

a mating portion provided with the moving pin;

a retaining member which interfaces with the mating portion;

an urging member which urges the moving pin in the axial direction; and a driving device which releases an engagement between the mating portion and the retaining member by receiving an external signal, wherein the urging member is separate from the driving device;

wherein said urging member comprises a coil spring, and said power shut-off connector further comprises:

a housing portion for accommodating the coil spring serving as the urging member, the housing portion being formed in the moving pin.

* * * * *